US008909521B2

(12) United States Patent
Moriya et al.

(10) Patent No.: US 8,909,521 B2
(45) Date of Patent: Dec. 9, 2014

(54) CODING METHOD, CODING APPARATUS, CODING PROGRAM, AND RECORDING MEDIUM THEREFOR

(75) Inventors: Takehiro Moriya, Kanagawa (JP); Noboru Harada, Kanagawa (JP); Yutaka Kamamoto, Kanagawa (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 308 days.

(21) Appl. No.: 13/322,174

(22) PCT Filed: May 28, 2010

(86) PCT No.: PCT/JP2010/059092

§ 371 (c)(1), (2), (4) Date: Dec. 1, 2011

(87) PCT Pub. No.: WO2010/140546

PCT Pub. Date: Dec. 9, 2010

(65) Prior Publication Data

US 2012/0093213 A1 Apr. 19, 2012

(30) Foreign Application Priority Data

Jun. 3, 2009 (JP) ..... 2009-134369

(51) Int. Cl.
*G10L 21/00* (2013.01)
*G10L 19/00* (2013.01)
*G10L 19/18* (2013.01)

(52) U.S. Cl.
CPC ..... *G10L 19/18* (2013.01)
USPC ..... 704/224; 704/219; 704/221

(58) Field of Classification Search
USPC ..... 704/219, 221, 224
See application file for complete search history.

(56) References Cited

U.S. PATENT DOCUMENTS

| | | | | |
|---|---|---|---|---|
| 7,408,918 | B1 | 8/2008 | Ramalho | |
| 2004/0028126 | A1 * | 2/2004 | Inokuchi | 375/240 |
| 2005/0261893 | A1 | 11/2005 | Toyama et al. | |

FOREIGN PATENT DOCUMENTS

| | | |
|---|---|---|
| CN | 1476599 A | 2/2004 |
| JP | 2002 372995 | 12/2002 |
| JP | 2008 209637 | 9/2008 |
| WO | 03 032296 | 4/2003 |

OTHER PUBLICATIONS

Chinese Office Action issued Aug. 13, 2013, in China patent Application 201080022884.0 (with English translation).
Office Action issued Sep. 10, 2013 in Japanese Patent Application No. 2011-518427 with English language translation.

(Continued)

*Primary Examiner* — Angela A Armstrong
(74) *Attorney, Agent, or Firm* — Oblon, Spivak, McClelland, Maier & Neustadt, L.L.P.

(57) ABSTRACT

A lossless coding technique for near-logarithmic companded PCM that achieves high compression performance is provided. In coding, the coding method that produces the smaller code amount is selected between the prediction coding method, which performs linear prediction of samples in a frame and codes the amplitude of the prediction error, and the normalization coding method, which normalizes the amplitude of the samples in the frame and codes the normalized amplitude, and a selection code that indicates the selection result is output. The samples in the frame are coded according to the selected coding method to produce a compression code. In decoding, the compression code is decoded according to a decoding process corresponding to the coding method specified by the selection code.

22 Claims, 24 Drawing Sheets

(56) References Cited

OTHER PUBLICATIONS

Hans, M., et al., "Lossless Compression of Digital Audio," IEEE Signal Processing Magazine, vol. 18, No. 4, pp. 21-32, (Jul. 2001).

Liebchen, T., et al., "MPEG-4 ALS: an Emerging Standard for Lossless Audio Coding," Proceedings of the Data Compression Conference (DCC'04), pp. 1-10, (2004).

International Search Report Issued Aug. 31, 2010 in PCT/JP10/059092 Filed May 28, 2010.

* cited by examiner

CODING METHOD, CODING APPARATUS, CODING PROGRAM, AND RECORDING MEDIUM THEREFOR

TECHNICAL FIELD

The present invention relates to a technique of lossless compression and coding of an input signal, such as an audio signal, and a technique of decoding the compressed code.

BACKGROUND ART

A lossless reversible coding method is a known method of compressing audio, visual or other information. In applications where a waveform is directly recorded as a linear PCM signal, various compression coding methods have been proposed (see Non-patent literature 1, for example). For example, a prediction coding method, such as MPEG-4 ALS, is known (see Non-patent literature 2, for example). The prediction coding method is to code a prediction error reduced in amplitude by linear prediction and a linear prediction coefficient.

In long-distance telephone transmission or audio transmission for Voice over Internet Protocol (VoIP), the near-logarithmic companded PCM standardized under ITU-T G.711, which uses 8 bits for each sample, is used instead of the linear PCM, which directly uses the numerical values of the amplitude. If the VoIP system becomes more popular than the ordinary telephone system, the required transmission capacity will increase, so that the demand for a lossless compression coding method based on the near-logarithmic companded PCM will also increase. In the VoIP system, the length of a frame, which is a unit of compression, is short in order to reduce the delay time, and each frame may be composed of 40 samples.

PRIOR ART LITERATURE

Non-Patent Literature

Non-patent literature 1: Mat Hans, Ronald W. Schafer, "Lossless Compression of Digital Audio", IEEE Signal Processing Magazine, July 2001, pp. 21-32

Non-patent literature 2: Tilman Liebchen, Yuriy A. Reznik, "MPEG4 ALS: an Emerging Standard for Lossless Audio Coding", Proceedings of the Date Compression Conference (DCC'04), 2004

SUMMARY OF THE INVENTION

Problem to be Solved by the Invention

There is a problem that when the number of samples in a frame is small, the prediction efficiency of the prediction coding method may be low, and the compression performance may be insufficient.

Means to Solve the Problems

To solve the problem described above, in coding, a coding method that produces a smaller code amount is selected between a prediction coding method, which performs linear prediction of samples in a frame and codes an amplitude of a prediction error, and a normalization coding method, which normalizes an amplitude of the samples in the frame and codes the normalized amplitude, and a selection code that indicates the selection result is output. The samples in the frame are coded according to the selected coding method to produce a compression code.

In decoding, the compression code is decoded according to a decoding process corresponding to the coding method specified by the selection code.

Effects of the Invention

Since the coding method that produces the smaller code amount is selected between the prediction coding method and the normalization coding method, the amount of code produced can be reduced compared with the case where only the prediction coding method is used.

DETAILED DESCRIPTION OF THE EMBODIMENTS

Coding Apparatus and Coding Method

First Embodiment

According to a first embodiment, codes for samples in the same frame are produced practically both by prediction coding and normalization coding. Then, the code amounts are compared between the prediction coding and the normalization coding, and the coding method that produces the smaller code amount is selected.

Figure 1:
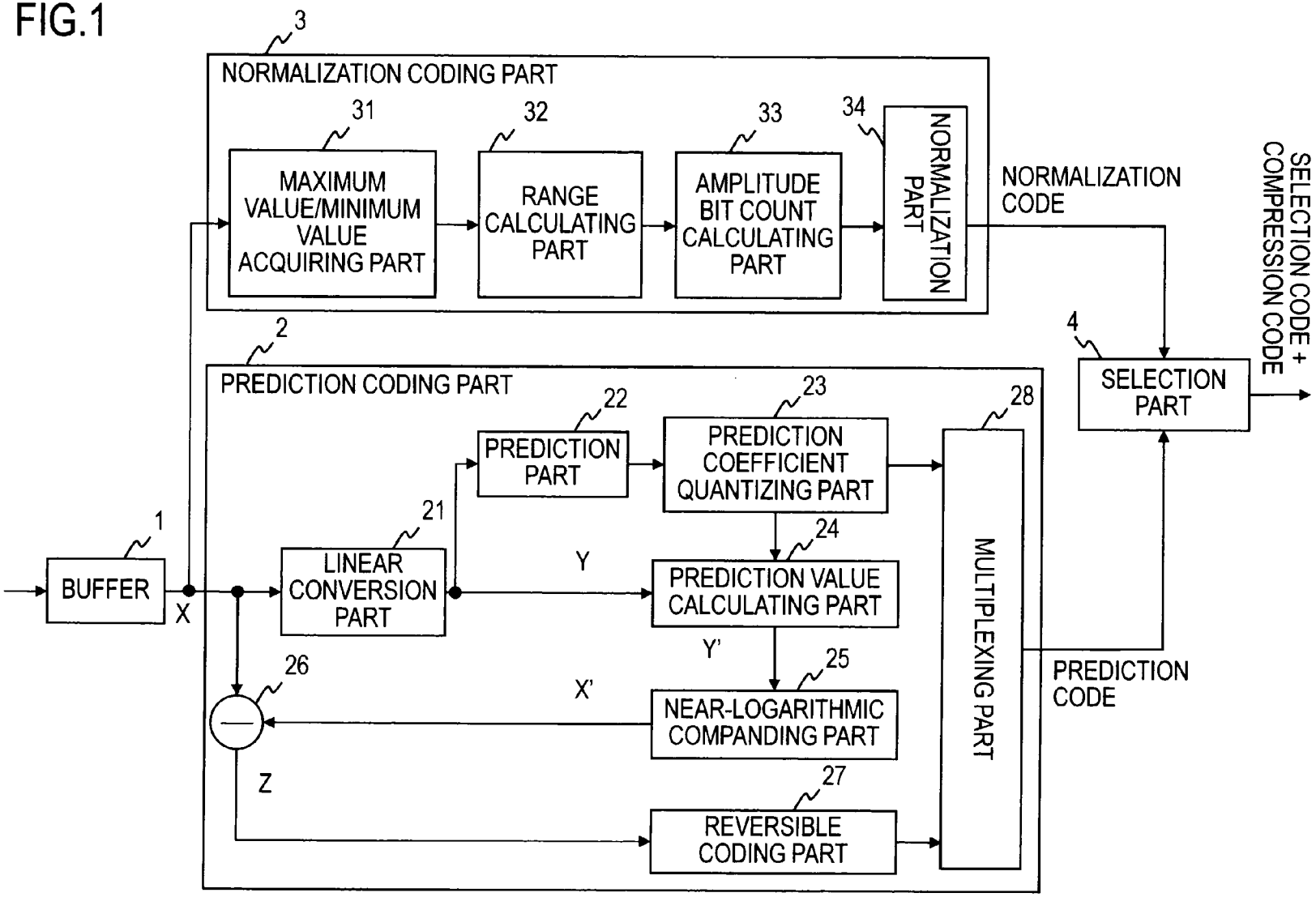
FIG. 1 is a functional block diagram showing an exemplary coding apparatus according to a first embodiment.
Figure 10:
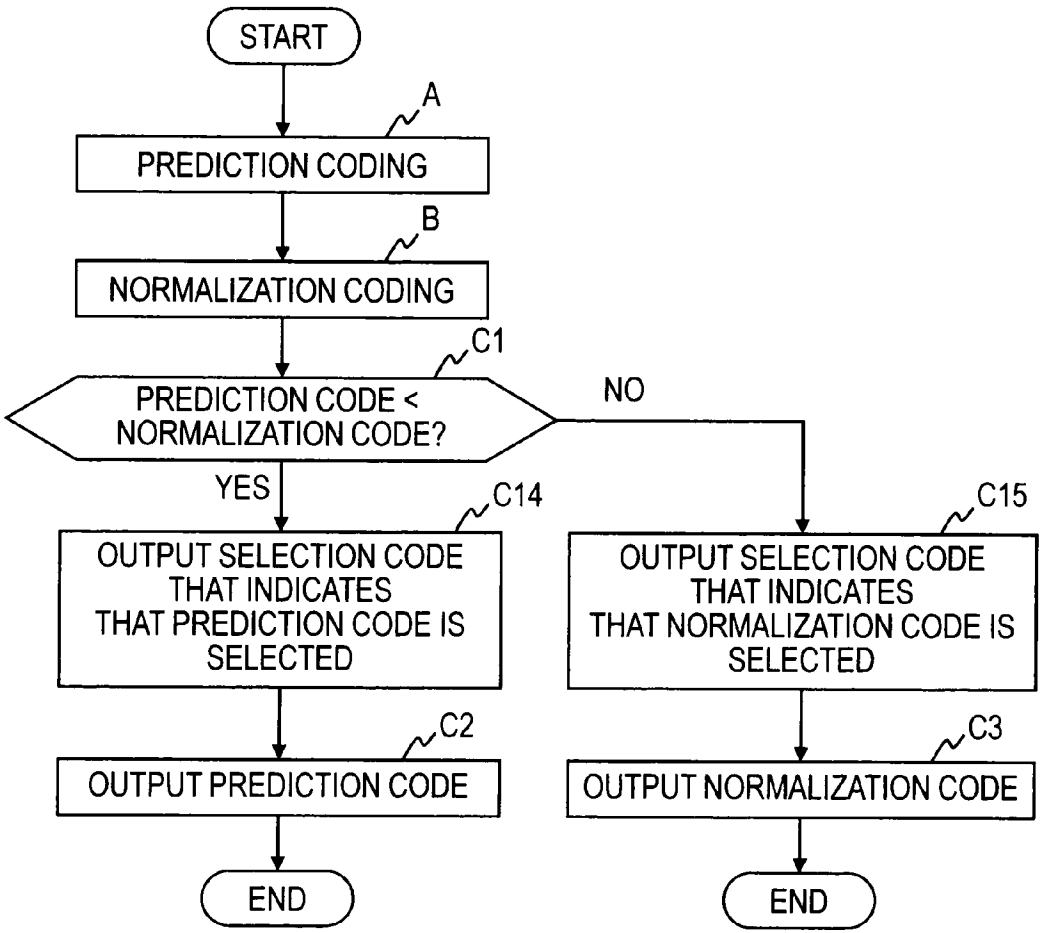
FIG. 10 is a flow chart showing an exemplary coding method according to the first embodiment.

FIG. 1 is a functional block diagram showing a coding apparatus according to the first embodiment. FIG. 10 is a flow chart showing a coding method according to the first embodiment.

The prediction coding method is to code the amplitude of a prediction error of linear prediction of a sample in a frame and is performed by a prediction coding part 2 (Step A). As illustrated in FIG. 1, the prediction coding part 2 includes a linear conversion part 21, a prediction part 22, a prediction coefficient quantizing part 23, a prediction value calculating part 24, a near-logarithmic companding part 25, a prediction error calculating part 26, a reversible coding part 27, and a multiplexing part 28.

Figure 11:
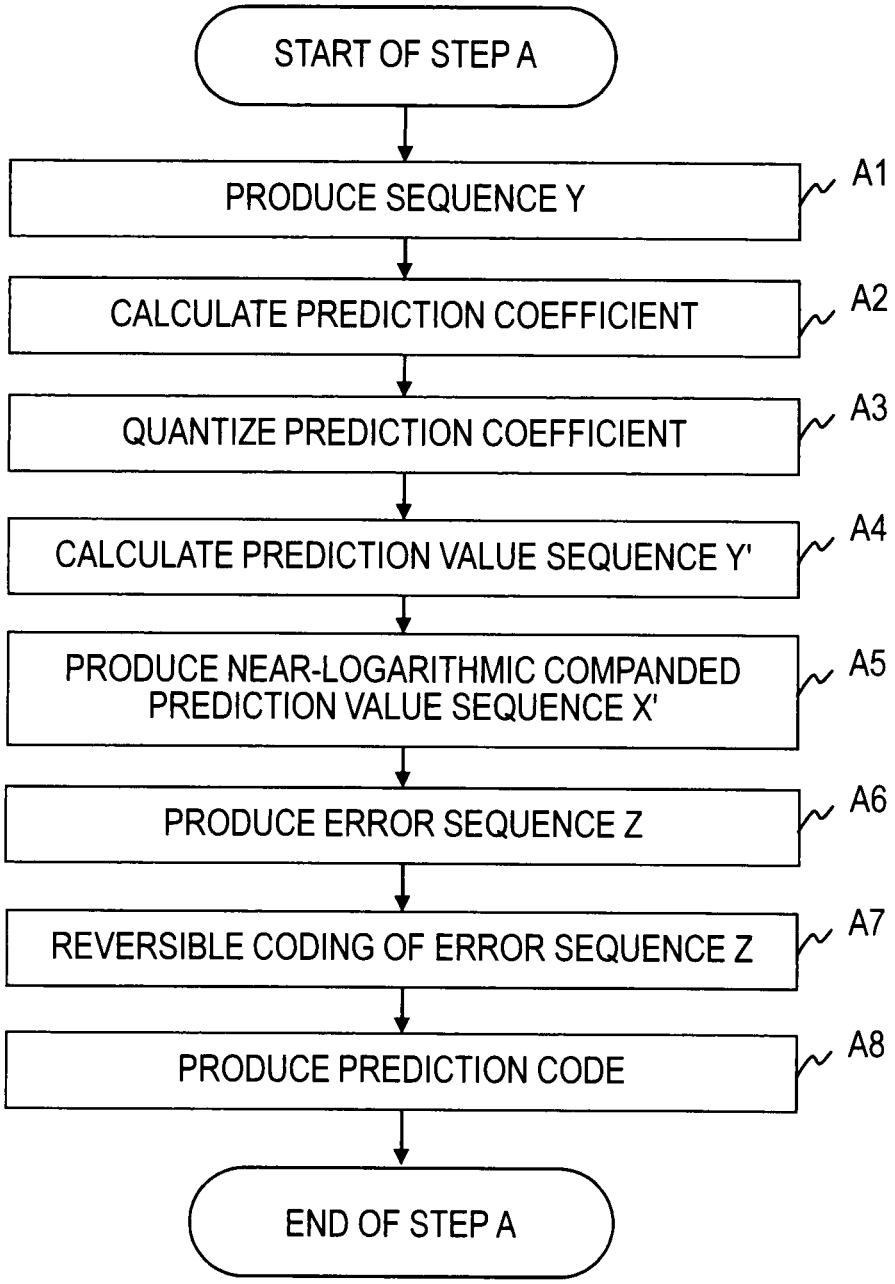
FIG. 11 is a flow chart showing an exemplary prediction coding process.

As illustrated in FIG. 11, Step A comprises Sub-Steps A1 to A8, for example. The linear conversion part 21 reads a near-logarithmic companded PCM sequence $X=\{x(1), x(2), \ldots, x(N)\}$ from a buffer 1, and converts the sequence into a linear PCM sequence $Y=\{y(1), y(2), \ldots, y(N)\}$ by converting each sample in the near-logarithmic companded PCM format into the linear PCM format (Sub-Step A1). "N" represents the number of samples in a frame. The sequence Y resulting from the conversion is passed to the prediction part 22 and the prediction value calculating part 24.

The sequence Y resulting from the conversion may not be the linear PCM sequence but also a PCM sequence Y close to the linear PCM sequence. The "PCM sequence Y close to the linear PCM sequence" refers to a sequence of signals intermediate between near-logarithmic companded PCM signals and linear PCM signals. For example, the PCM sequence Y close to the linear PCM sequence can be determined by weighted addition of the near-logarithmic companded PCM sequence and the linear PCM sequence on a sample basis.

Figure 22:
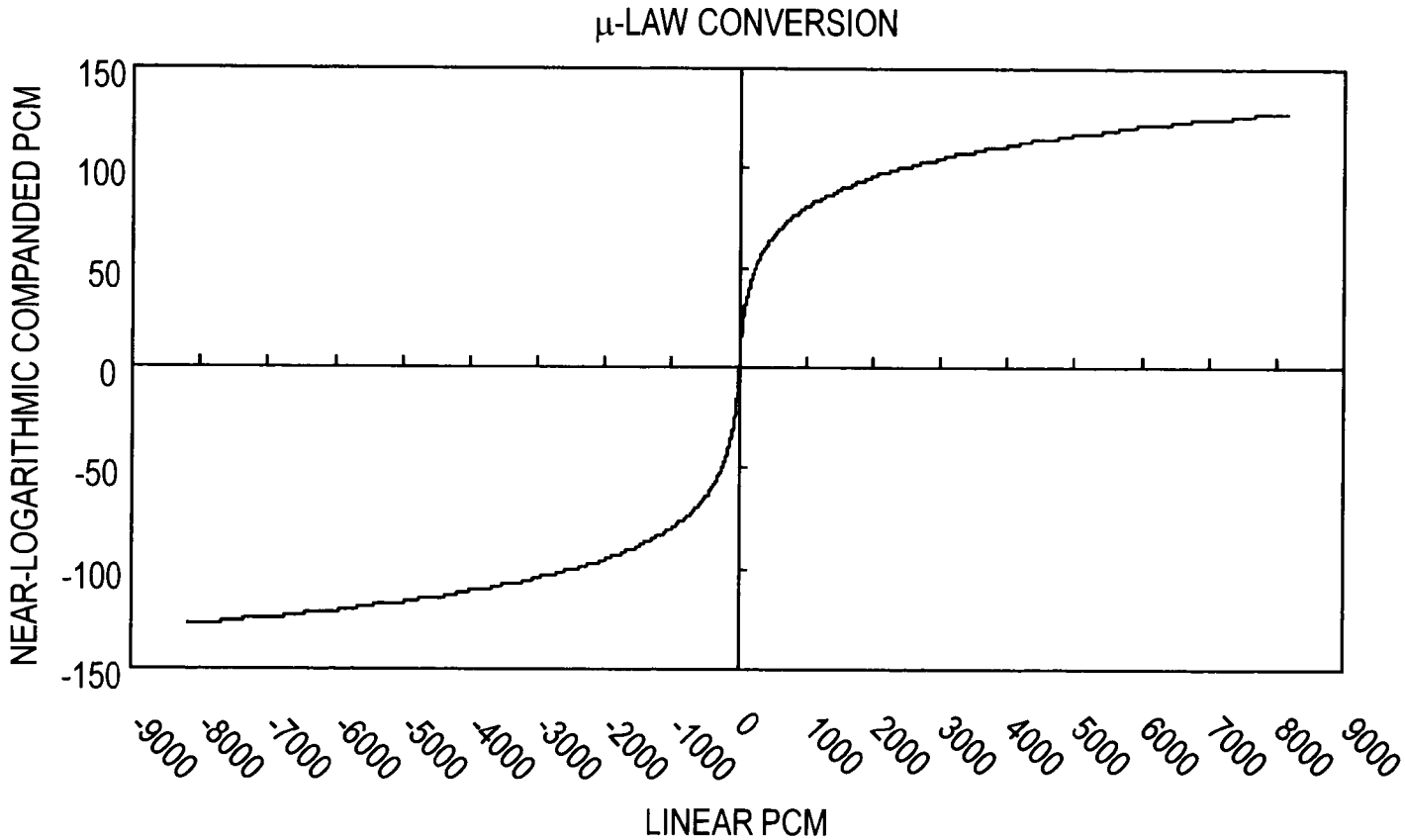
FIG. 22 illustrates a relationship between linear PCM and near-logarithmic companded PCM.

FIG. 22 illustrates a relationship between the linear PCM and the near-logarithmic companded PCM. This example concerns a case of the μ-law, which is used in Japan and the USA.

The prediction part 22 performs linear prediction analysis of the sequence Y and calculates a prediction coefficient (Sub-Step A2). The prediction part 22 may calculate a prediction coefficient used for short-term prediction or a prediction coefficient used for long-term prediction. The calculated prediction coefficient is passed to the prediction coefficient quantizing part 23.

The prediction coefficient quantizing part 23 quantizes the calculated prediction coefficient and passes the quantized prediction coefficient to the prediction value calculating part 24 and a code expressing the quantized prediction coefficient (referred to also as a coefficient code) to the multiplexing part 28 (Sub-Step A3).

Using the sequence Y and the quantized prediction coefficient, the prediction value calculating part 24 calculates a prediction value sequence $Y'=\{y'(1), y'(2), \ldots, y'(N)\}$, which is a sequence of the prediction values of the sequence Y (Sub-Step A4). The prediction value sequence Y' is passed to the near-logarithmic companding part 25.

The near-logarithmic companding part 25 converts each sample in the prediction value sequence Y' into a near-logarithmic companded PCM format to produce a near-logarithmic companded prediction value sequence $X'=\{x'(1), x'(2), \ldots, x'(N)\}$ (Sub-Step A5). The near-logarithmic companded prediction value sequence X' is passed to the prediction error calculating part 26.

Using the near-logarithmic companded PCM sequence X and the near-logarithmic companded prediction value sequence X', the prediction error calculating part 26 calculates an error sequence $Z=\{z(1), z(2), \ldots, z(N)\}$, which is a sequence of errors between the samples in the near-logarithmic companded PCM sequence X and the samples in the near-logarithmic companded prediction value sequence X' (Sub-Step A6). The error sequence Z is passed to the reversible coding part 27. A relation holds: $x(i)=x'(i)+z(i)$, where $i=1, \ldots, N$.

The reversible coding part 27 performs reversible coding of the error sequence Z to produce error codes (Sub-Step A7). The error codes are passed to the multiplexing part 28. For example, the error codes can be produced by Rice coding.

The multiplexing part 28 combines the coefficient code and the error codes to form a prediction code, and outputs the prediction code to a selection part 4 (Sub-Step A8).

The normalization coding method is to normalize and code the amplitude of a sample in a frame and is performed by the normalization coding part 3 (Step B). The normalization coding method is a simple coding method and can achieve higher compression efficiency than the prediction coding method if the number of samples in one frame is small. For details on the normalization coding method, see U.S. Pat. No. 7,408,918, for example. As illustrated in FIG. 1, the normalization coding part 3 includes, for example, a maximum value/minimum value acquiring part 31, a range calculating part 32, an amplitude bit count calculating part 33, and a normalization part 34.

Figure 12:
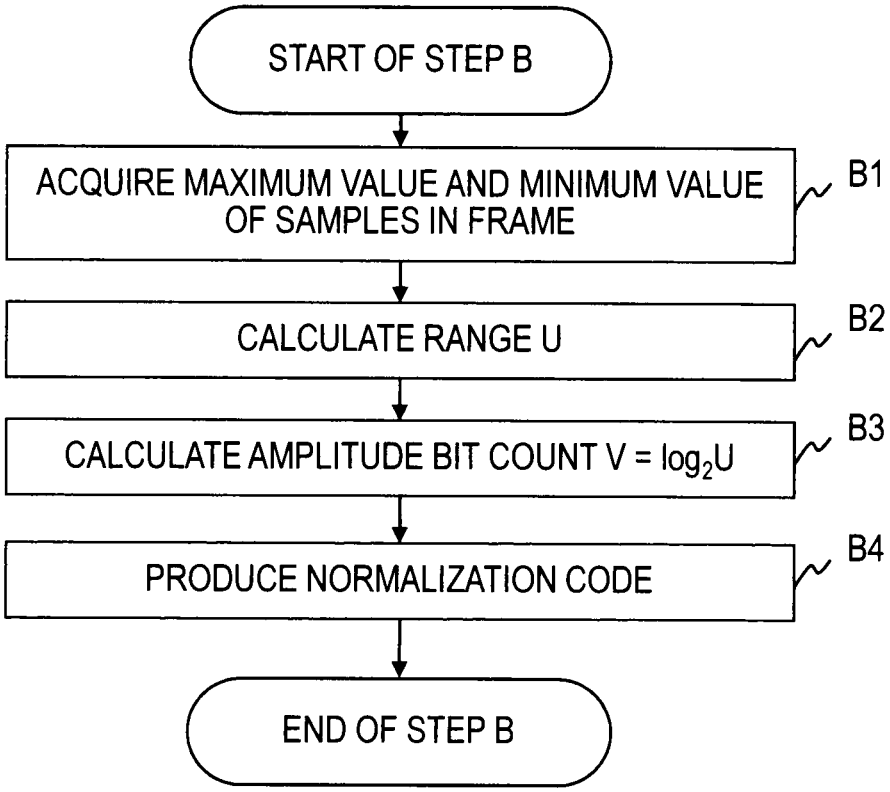
FIG. 12 is a flow chart showing an exemplary normalization coding process.

Step B comprises Sub-Steps B1 to B4, for example, as illustrated in FIG. 12. The maximum value/minimum value acquiring part 31 reads the near-logarithmic companded PCM sequence X from the buffer 1 and acquires the maximum value and the minimum value from the samples in the frame by regarding the samples as numerical values as they are without converting them into the linear PCM format (Sub-Step B1). The acquired maximum value and minimum value are passed to the range calculating part 32.

The range calculating part 32 calculates a range U, which is a value obtained by adding 1 to the difference between the maximum value and the minimum value (Sub-Step B2). The range U is passed to the amplitude bit count calculating part 33. Alternatively, the range U may be a value obtained by doubling the larger one of the absolute values of the maximum value and the minimum value and adding 1 to the doubled value. This range U is larger than the value obtained by adding 1 to the difference between the maximum value and the minimum value. However, a deviation amount d described later can be regarded as being always 0 to omit calculation and transmission of the deviation amount d.

An equivalent process can be provided by replacing the processings performed by the maximum value/minimum value acquiring part 31 and the range calculating part 32 with the following processings. That is, the maximum value/minimum value acquiring part 31 acquires one of the maximum value and the minimum value that has the larger absolute value. The acquired value with the larger absolute value is passed to the range calculating part 32. The range calculating part 32 calculates the range U by doubling the absolute value of the value and adding 1 to the resulting value. Note that the calculation of the range U depends on the definition of the relationship between the near-logarithmic companded PCM and the linear PCM in the case where the samples in the near-logarithmic companded PCM sequence are used as numerical values as they are. The relationship can be defined in any way as far as the monotonic magnitude relationship with the linear PCM is maintained, and there is a flexibility in relationship about the value 0, for example. The addition of 1 in the calculation of the range U described above can be omitted depending on the definition of the relationship, such as in the case where the definition of the relationship specifies the relationships about only the positive and negative values and specifies no relationship about 0.

In short, the maximum value/minimum value acquiring part 31 and the range calculating part 32 can perform any processings that determine a range U that is equal to or greater than the range containing the values of all the samples in a frame based on the values of all the samples in the frame in the case where the near-logarithmic companded PCM samples are regarded as numerical values as they are.

The amplitude bit count calculating part 33 calculates the amplitude bit count V according to $V=\log_2 U$ (Sub-Step B3). The calculated amplitude bit count V is passed to the normalization part 34. Each sample in the frame can be expressed by a number of bits equal to the amplitude bit count V.

Using the amplitude bit count V, the normalization part 34 normalizes the samples in the frame to produce a normalization code (Sub-Step B4). The produced normalization code is passed to the selection part 4.

In the following, an example of the normalization will be described. The normalization part 34 first determines the deviation amount d. For example, the deviation amount is an average value of the maximum value and the minimum value of the values of the samples in the frame determined by the maximum value/minimum value acquiring part 31. Alternatively, the deviation amount d may be the minimum value of the values of the samples in the frame. The values of the samples in the frame are shifted by the deviation amount d. That is, the deviation amount d is subtracted from the value of each sample in the frame. The normalization part 34 combines the deviation amount, the amplitude bit count V and the values of the samples shifted by the deviation amount d to form the normalization code.

The selection part 4 compares the code amount of the prediction code produced by the prediction coding part 2 and the code amount of the normalization code produced by the normalization coding part 3 and selects the one that has the smaller code amount (Sub-Step C1). The selection part 4 outputs the code produced according to the selected coding method as a compression code as well as a selection code that indicates the selection result. That is, if the code amount of the prediction code is smaller than the code amount of the normalization code, the prediction code is output as the compression code along with the selection code (Sub-Steps C2, C14). If the code amount of the normalization code is smaller than the code amount of the prediction code, the normalization code is output as the compression code along with the selection code (Sub-Steps C3, C15).

As described above, since the prediction coding and the normalization coding are performed in practice to select the coding method that provides the smaller code amount, the coding method that provides the smaller code amount can be selected with reliability. Note that the linear conversion part 21 and the near-logarithmic companding part 25 in the prediction coding part 2 may be omitted.

Second Embodiment

According to second to eighth embodiments, the coding method that provides the smaller code amount is selected based on data produced in the course of prediction coding by a prediction coding part 2 and/or data produced in the course of normalization coding by a normalization coding part 3.

According to the second embodiment, based on a prediction coefficient calculated by the prediction coding part 2, the coding method that provides the smaller code amount is selected. The larger the prediction coefficient, the higher the probability that the prediction coding exhibits superior compression performance tends to be. Therefore, when the prediction coefficient, such as a linear prediction coefficient, is large, it is determined that the prediction coding method is superior to the normalization coding method in compression performance, and the prediction coding method is selected.

Figure 2:
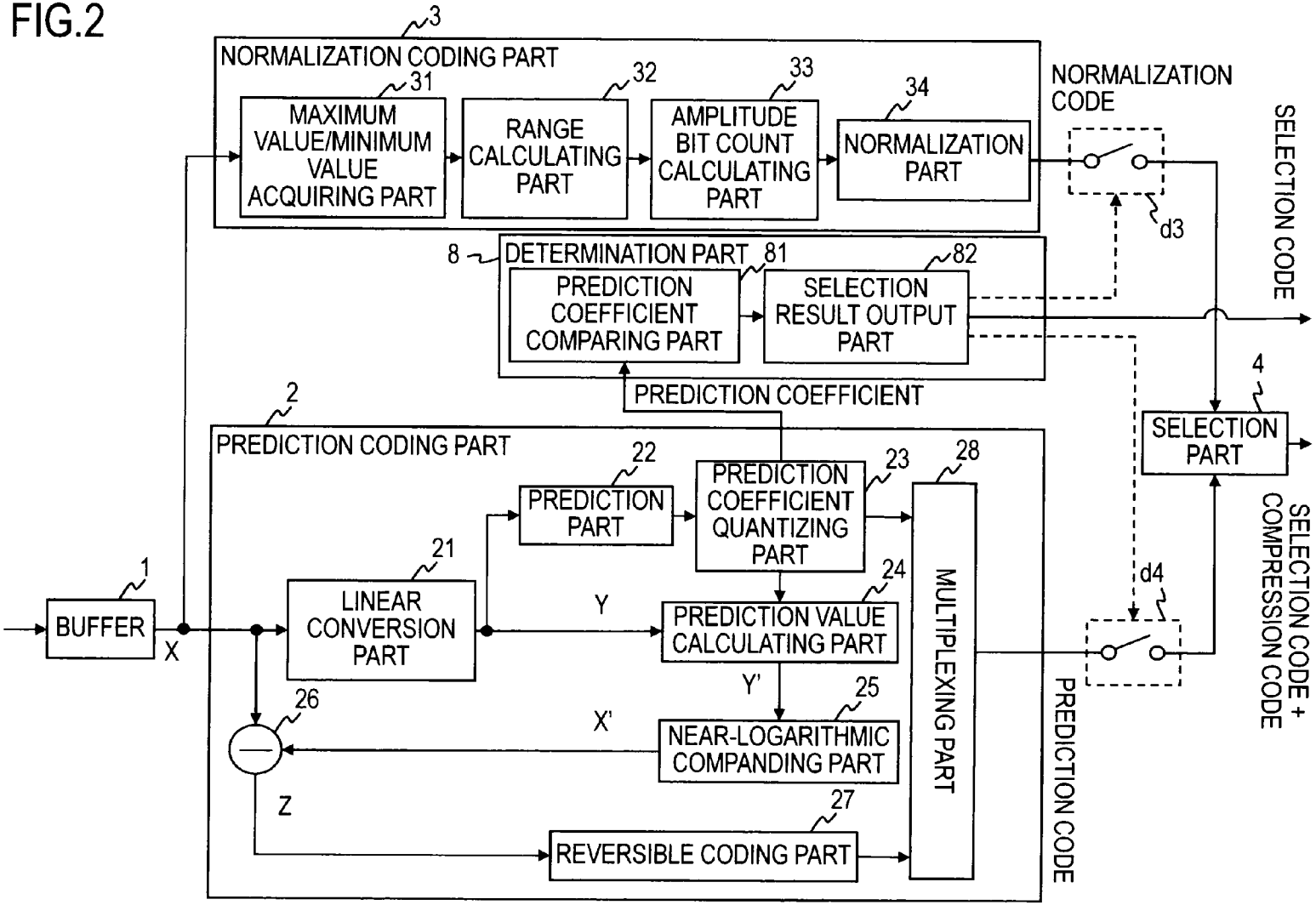
FIG. 2 is a functional block diagram showing an exemplary coding apparatus according to a second embodiment.
Figure 13:
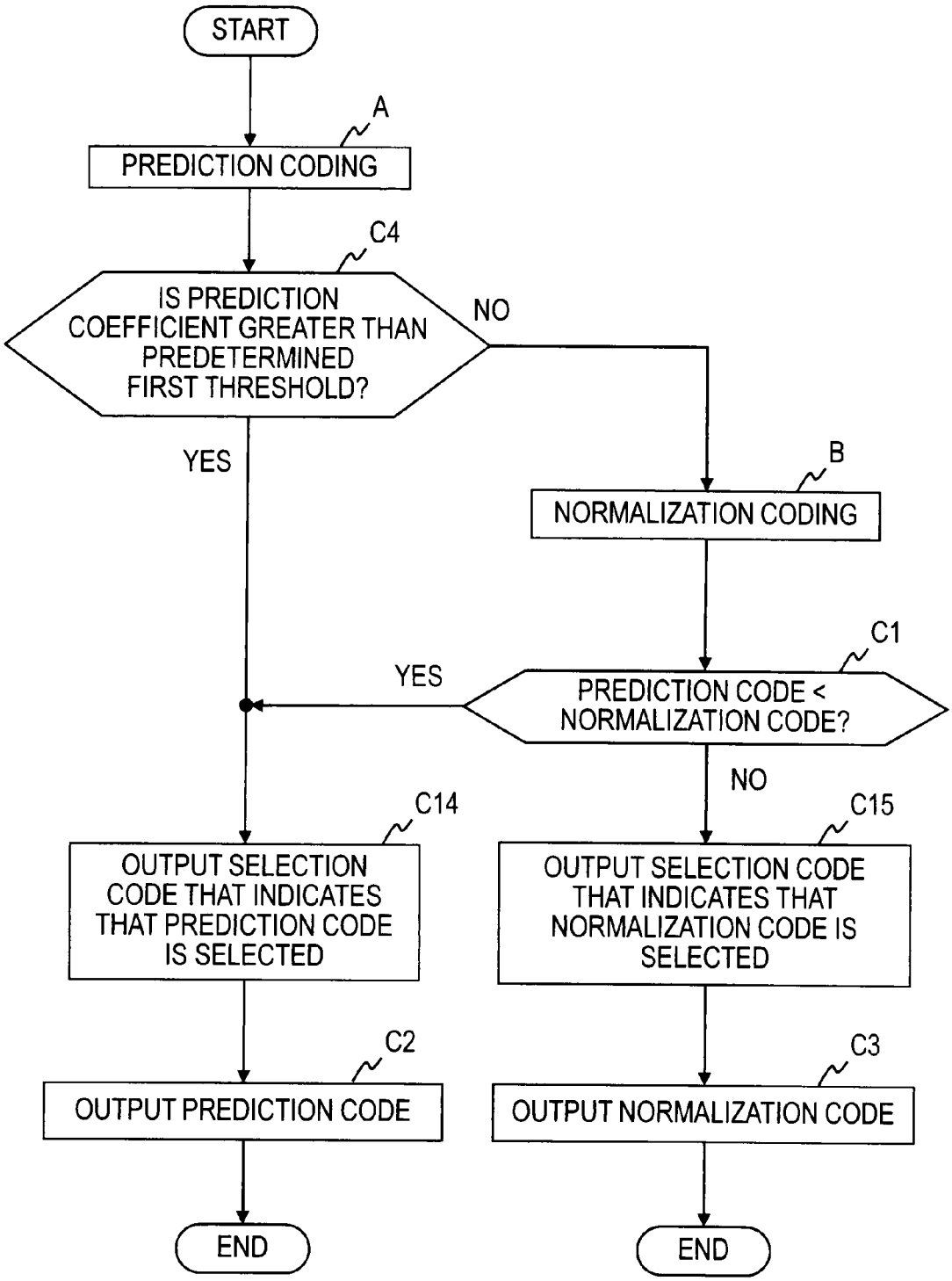
FIG. 13 is a flow chart showing an exemplary coding method according to the second embodiment.

FIG. 2 is a functional block diagram showing a coding apparatus according to the second embodiment. FIG. 13 is a flow chart showing an exemplary coding method according to the second embodiment.

The prediction coding part 2 performs the processing in Step A to produce a prediction code (Step A). The prediction coefficient quantized by a prediction coefficient quantizing part 23 in Sub-Step A3 is passed to a determination part 8.

The determination part 8 includes a prediction coefficient comparing part 81 and a selection result output part 82.

The prediction coefficient comparing part 81 compares any one prediction coefficient (a first-order prediction coefficient, for example) with a predetermined first threshold (Sub-Step C4). The comparison result is passed to the selection result output part 82.

If the prediction coefficient is larger than the predetermined first threshold, the selection result output part 82 outputs a selection code that indicates to select the prediction coding method (Sub-Step C14). In addition, the selection result output part 82 turns off a switch d3 and turns on a switch d4. By this operation, the prediction code is output (Sub-Step C2). The predetermined first threshold is a constant appropriately set based on the required performance, specification or the like.

If the prediction coefficient is smaller than the predetermined first threshold, the normalization coding part 3 performs the processing in Step B to produce the normalization code.

In this case, as in the first embodiment, a selection part 4 compares the code amount of the prediction code produced by the prediction coding part 2 and the code amount of the normalization code produced by the normalization coding part 3 and selects the coding method that provides the smaller code amount (Sub-Step C1). The selection part 4 outputs the code produced according to the selected coding method as the compression code as well as the selection code that indicates the selection result. That is, if the code amount of the prediction code is smaller than the code amount of the normalization code, the prediction code is output as the compression code along with the selection code (Sub-Steps C2, C14). If the code amount of the normalization code is smaller than the code amount of the prediction code, the normalization code is output as the compression code along with the selection code (Sub-Steps C3, C15).

As described above, since the coding method that provides the smaller code amount is selected based on data produced in the course of prediction coding by the prediction coding part 2 and/or data (the prediction coefficient, in this embodiment) produced in the course of normalization coding by the normalization coding part 3, the prediction coding method and the normalization coding method do not have to be performed in their entirety, and thus, the calculation amount is reduced.

All the sub-steps in the prediction coefficient step A do not necessarily performed before Sub-Step C4. It is essential only that the prediction coefficient is determined through Sub-Steps A1 to A3. In that case, following Sub-Step C4, processings in Sub-Steps A4 to A8 are performed. This allows further reduction of the calculation amount.

Third Embodiment

According to the third embodiment, the coding method that provides the smaller code amount is selected based on a prediction coefficient calculated by a prediction coding part 2 and a range U calculated by a normalization coding part 3.

Figure 23:
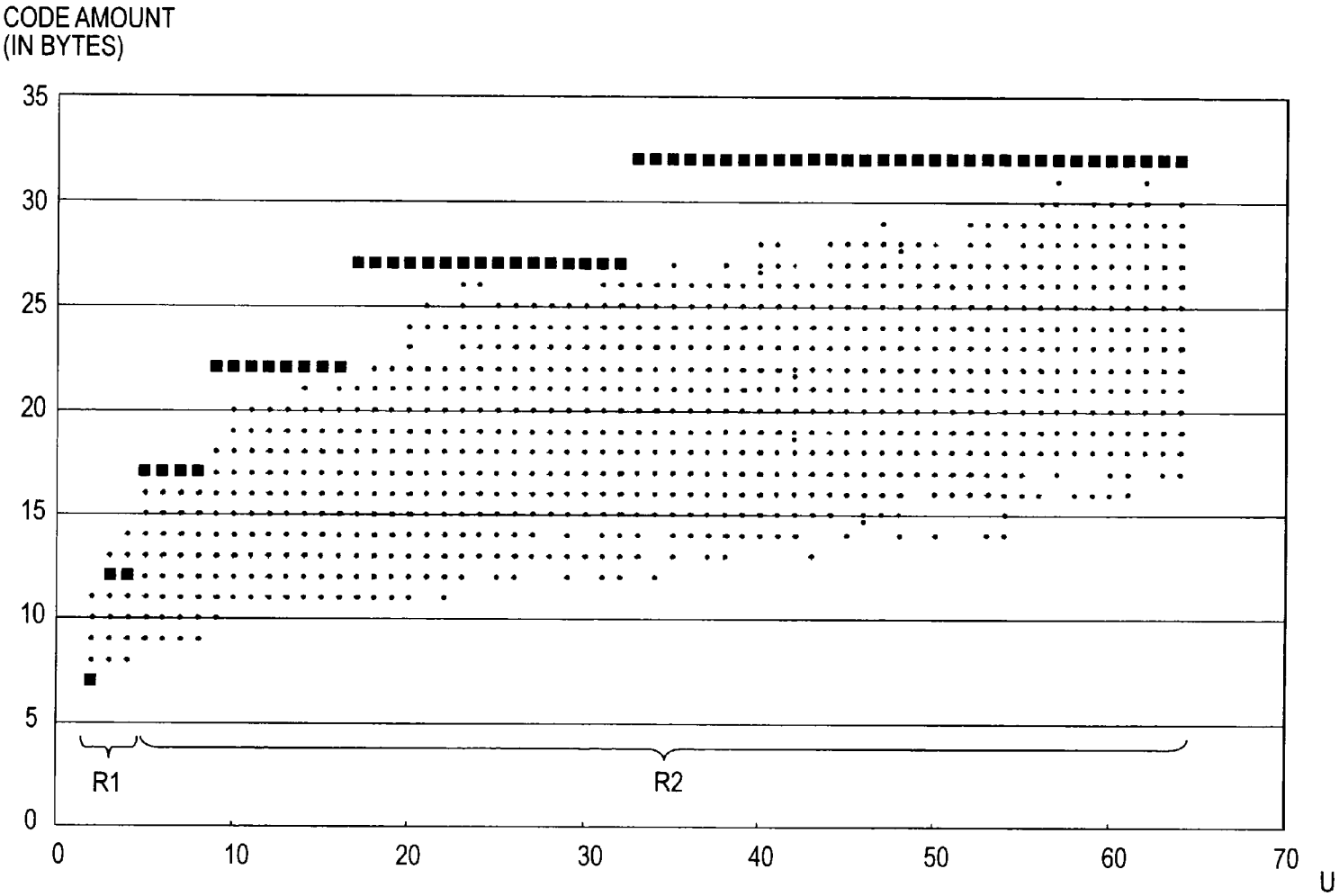
FIG. 23 illustrates a relationship between the code amount for the prediction coding method and the code amount for the normalization coding method for different ranges U in the case where a prediction coefficient (PARCOR coefficient, in this example) is equal to or greater than 0.7.

In general, as the prediction coefficient becomes larger, the prediction coding method is more likely to be superior to the normalization coding method in compression performance. However, even if the prediction coefficient is large, the normalization coding method can be superior to the prediction coding method in compression performance if the range U is small. FIG. 23 illustrates a relationship between the code amount for the prediction coding method and the code amount for the normalization coding method for different ranges U in the case where the prediction coefficient (a PARCOR coefficient, in this embodiment) is equal to or greater than 0.7. In this drawing, the black squares ■ represent the code amount for the normalization coding method, and the dots • represent the code amount for the prediction coding method. In a region R2 in which the range U is equal to or greater than 4, the code amount for the prediction coding method is smaller than that for the normalization coding method, whereas the code amount for the prediction coding method is not always smaller than that for the normalization coding method in a region R1 in which the range U is smaller than 4.

In view of this, according to the third embodiment, if the prediction coefficient is large, and the range U is not small, the following processing steps are omitted, and the prediction coding method is selected, because the possibility that the normalization coding method provides the smaller code amount is extremely low. Otherwise, the code amounts of the prediction code and the normalization code are estimated or calculated in practice, and the coding method that provides the smaller code amount is selected based on the estimation or calculation.

Figure 3:
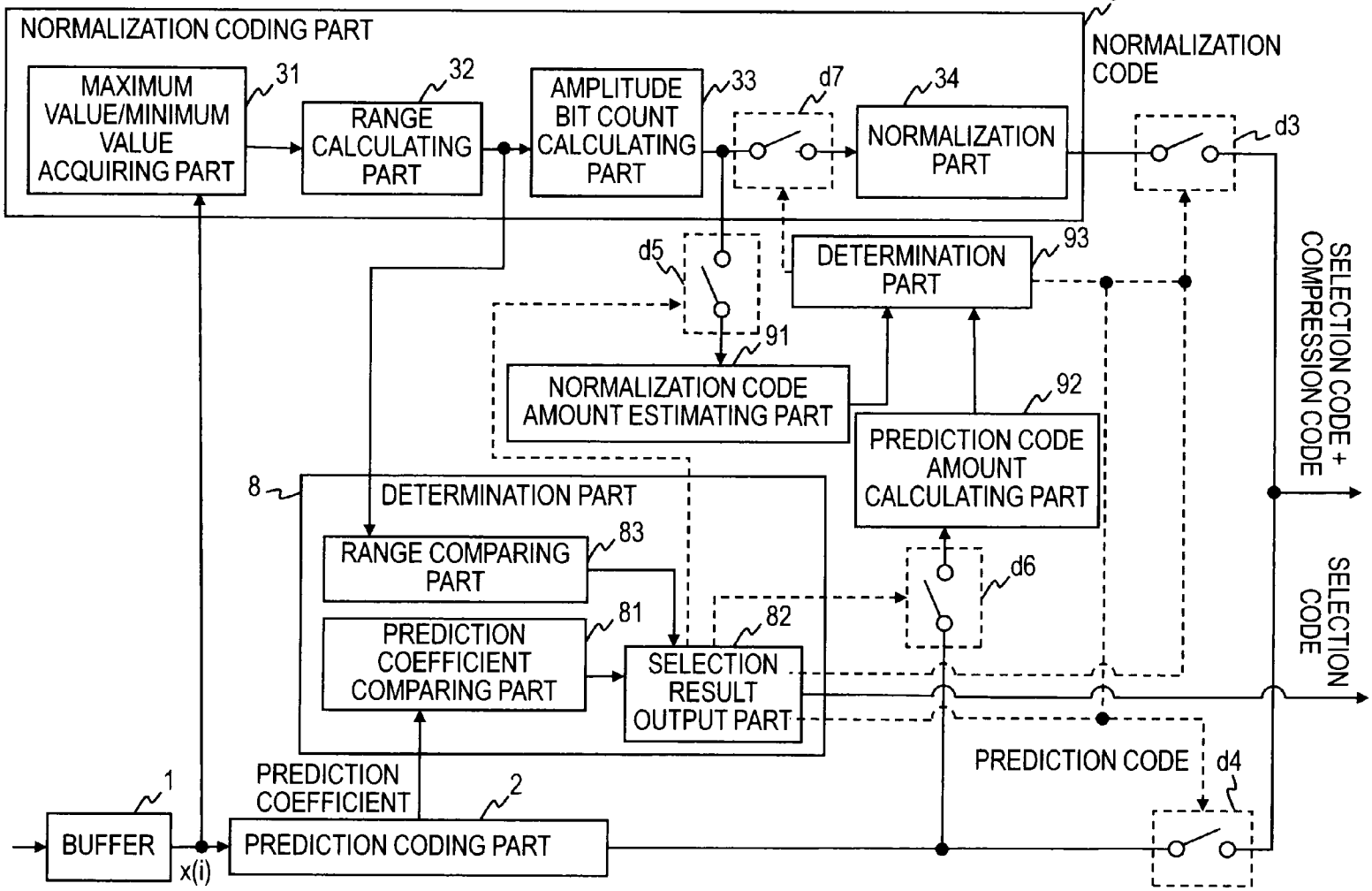
FIG. 3 is a functional block diagram showing an exemplary coding apparatus according to a third embodiment.
Figure 14:
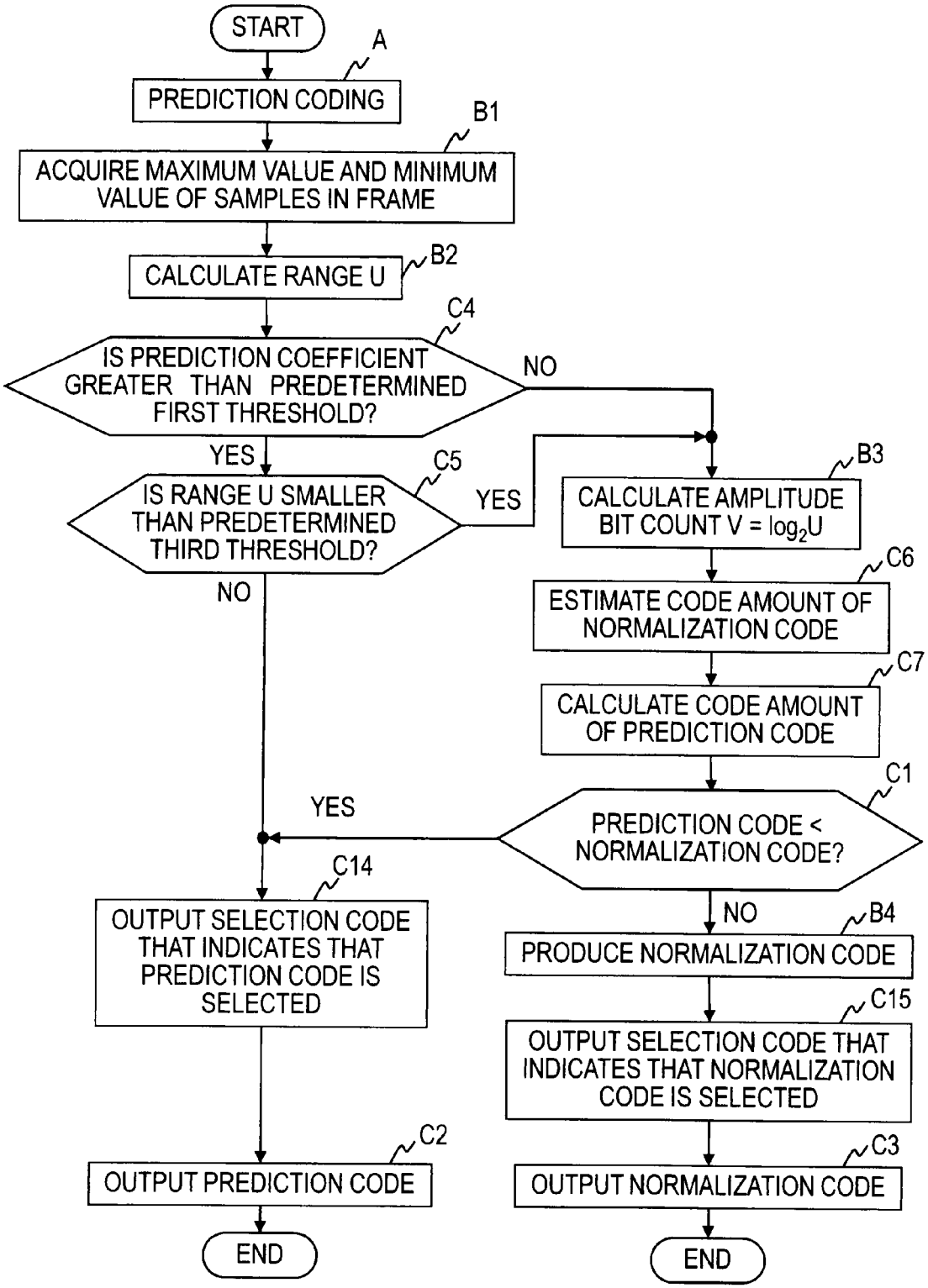
FIG. 14 is a flow chart showing an exemplary coding method according to the third embodiment.

FIG. 3 is a functional block diagram showing a coding apparatus according to the third embodiment, and FIG. 14 is a flow chart showing a coding method according to the third embodiment.

The prediction coding part 2 performs the processing in Step A to produce the prediction code (Step A). The prediction coefficient quantized by a prediction coefficient quantizing part 23 in Sub-Step A3 is passed to a determination part 8.

A maximum value/minimum value acquiring part 31 reads a near-logarithmic companded PCM sequence X from a buffer 1 and acquires the maximum value and the minimum value from the samples in a frame (Sub-Step B1). The acquired maximum value and minimum value are passed to a range calculating part 32.

The range calculating part 32 calculates a range U, which is a value obtained by adding 1 to the difference between the maximum value and the minimum value (Sub-Step B2). The range U is passed to an amplitude bit count calculating part 33 and the determination part 8.

The determination part 8 includes a prediction coefficient comparing part 81, a selection result output part 82, and a range comparing part 83. The prediction coefficient comparing part 81 compares the prediction coefficient with a predetermined first threshold (Sub-Step C4). The comparison result is passed to the selection result output part 82.

The range comparing part 83 compares the range U with a predetermined third threshold (Sub-Step C5). The comparison result is passed to the selection result output part 82.

If the prediction coefficient is larger than the predetermined first threshold, and the range U is not smaller than the predetermined third threshold, the selection result output part 82 outputs a selection code that indicates to select the prediction coding method (Sub-Step C14). In addition, the selection result output part 82 turns off a switch d3 and turns on a switch d4. By this operation, the prediction code is output (Sub-Step C2). The predetermined first threshold and the predetermined third threshold are constants appropriately set based on the required performance, specification or the like.

If the prediction coefficient is smaller than the predetermined first threshold, or the range U is smaller than the predetermined third threshold, the selection result output part 82 turns on switches d5 and d6. Then, the amplitude bit count calculating part 33 calculates the amplitude bit count V according to $V=\log_2 U$ (Sub-Step B3). The calculated amplitude bit count V is passed to a normalization part 34 and a normalization code amount estimating part 91.

The normalization code amount estimating part 91 estimates the code amount of the normalization code based on the amplitude bit count V (Sub-Step C6). For example, the number of bytes W per frame of the normalization code is estimated according to $W=NV/8+2$, where N represents the number of samples in a frame. The estimated number of bytes W is regarded as the estimated normalization code amount. The estimated normalization code amount is passed to a determination part 93.

A prediction code amount calculating part 92 calculates the code amount of the prediction code produced by the prediction coding part 2 (Sub-Step C7). The calculated code amount of the prediction code is passed to the determination part 93.

The determination part 93 compares the code amount of the prediction code and the code amount of the normalization code and selects the coding method that provides the smaller code amount (Sub-Step C1). The code produced according to the selected coding method is output along with a selection code that indicates the selection result. If the code amount of the prediction code is smaller than the code amount of the normalization code, the determination part 93 turns on the switch d4 and turns off the switch d3 and a switch d7. If the code amount of the normalization code is smaller than the code amount of the prediction code, the determination part 93 turns on the switches d3 and d7 and turns off the switch d4.

Thus, if the code amount of the prediction code is smaller than the code amount of the normalization code, the prediction code is output as the compression code along with the selection code (Sub-Steps C2, C14). If the code amount of the normalization code is smaller than the code amount of the prediction code, the normalization part 34 normalizes the samples in the frame using the amplitude bit count V to produce the normalization code (Sub-Step B4). Then, the produced normalization code is output as the compression code along with the selection code (Sub-Steps C3, C15).

As described above, since the coding method that provides the smaller code amount is selected based on data produced in the course of prediction coding by the prediction coding part 2 and/or data produced in the course of normalization coding by the normalization coding part 3, the prediction coding method and the normalization coding method do not have to be performed in their entirety, and thus, the calculation amount is reduced.

Fourth Embodiment

According to a fourth embodiment, the coding method that provides the smaller code amount is selected based on a prediction coefficient calculated by a prediction coding part 2 and a range U calculated by a normalization coding part 3.

In general, as the prediction coefficient becomes smaller, the normalization coding method is more likely to be superior to the prediction coding method in compression performance. However, even if the prediction coefficient is small, the prediction coding method can provide a smaller code amount than the normalization coding method if the range U is equal to or smaller than a power of 2 and is close to the power of 2.

Figure 24:
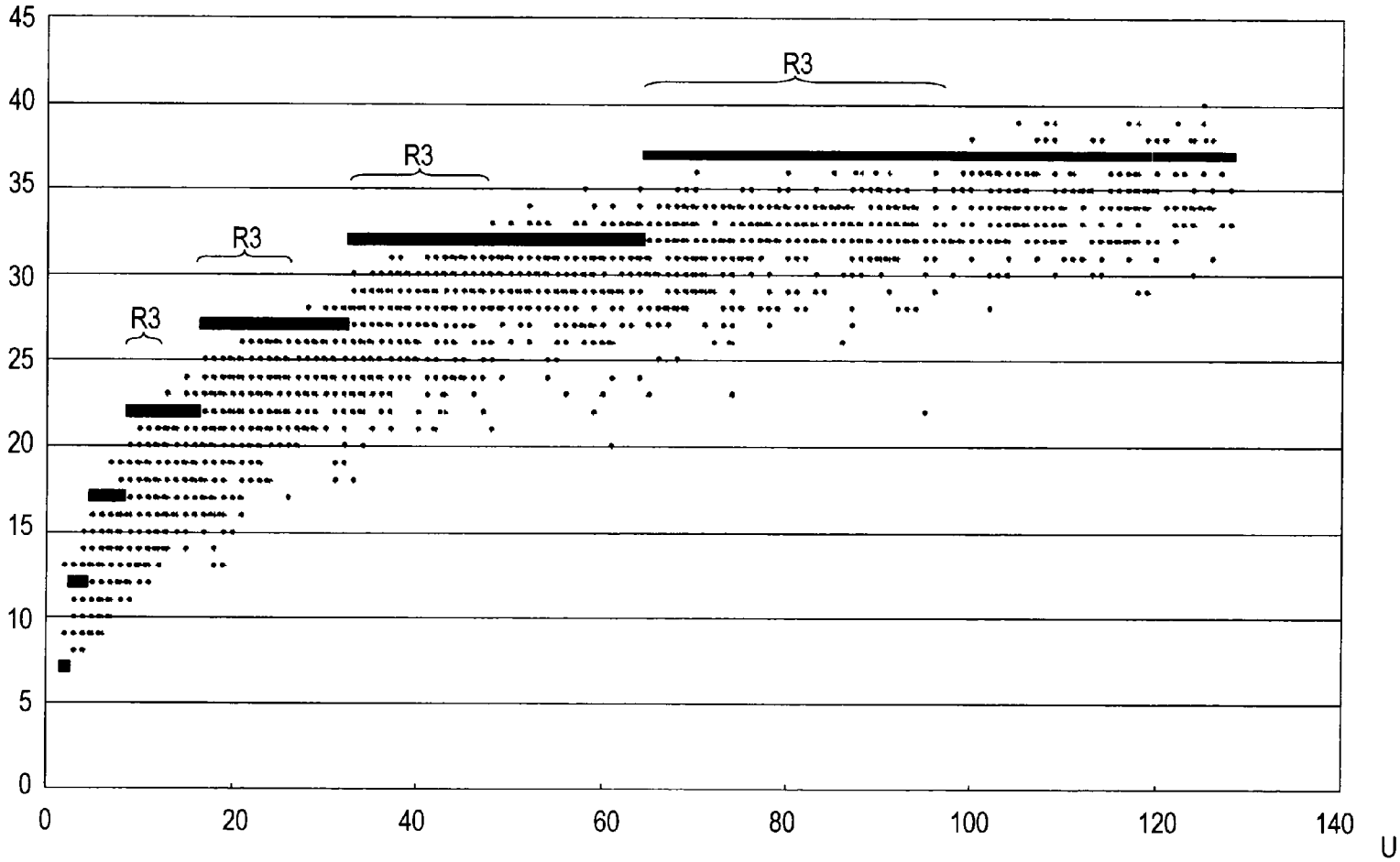
FIG. 24 illustrates a relationship between the code amount for the prediction coding method and the code amount for the normalization coding method for different ranges U in the case where the prediction coefficient (PARCOR coefficient, in this example) is equal to or less than 0.7.

FIG. 24 illustrates a relationship between the code amount of a prediction code and the code amount of a normalization code for different ranges U in the case where the prediction coefficient (a PARCOR coefficient, in this embodiment) is equal to or greater than 0.7. In this drawing, the thick lines represent the code amount of the normalization code, and the dots represent the code amount of the prediction code. The code amount of the normalization code varies stepwise. For example, if the range U is equal to or smaller than 128 ($=2^7$) or 64 ($=2^6$) and is close to 128 or 64, there is a possibility that the code amount of the normalization code is smaller than that of the prediction code. On the other hand, if the range U is equal to or smaller than 128 or 64 but is far from 128 or 64, that is, in a region R3, the code amount of the prediction code is smaller than the code amount of the normalization code.

The fourth embodiment takes advantage of this property. Even if the prediction coefficient is small, the prediction coding method is selected if the range U is equal to or smaller than $2\hat{}(\lceil \log_2 U \rceil)*\beta$ where the symbol $\lceil \bullet \rceil$ represents the smallest integer equal to or greater than •, and β represents a positive constant equal to or greater than 1 (0.75, for example). The prediction coding method is also selected if the range U is equal to or smaller than $2\hat{}(\lceil \log_2 U \rceil)-\alpha$, where α represents a predetermined constant. In the following description, $2\hat{}(\lceil \log_2 U \lceil)*\beta$ can be interchanged with $2\hat{}(\lceil \log_2 U \rceil)-\alpha$ to provide the same effect.

Figure 15:
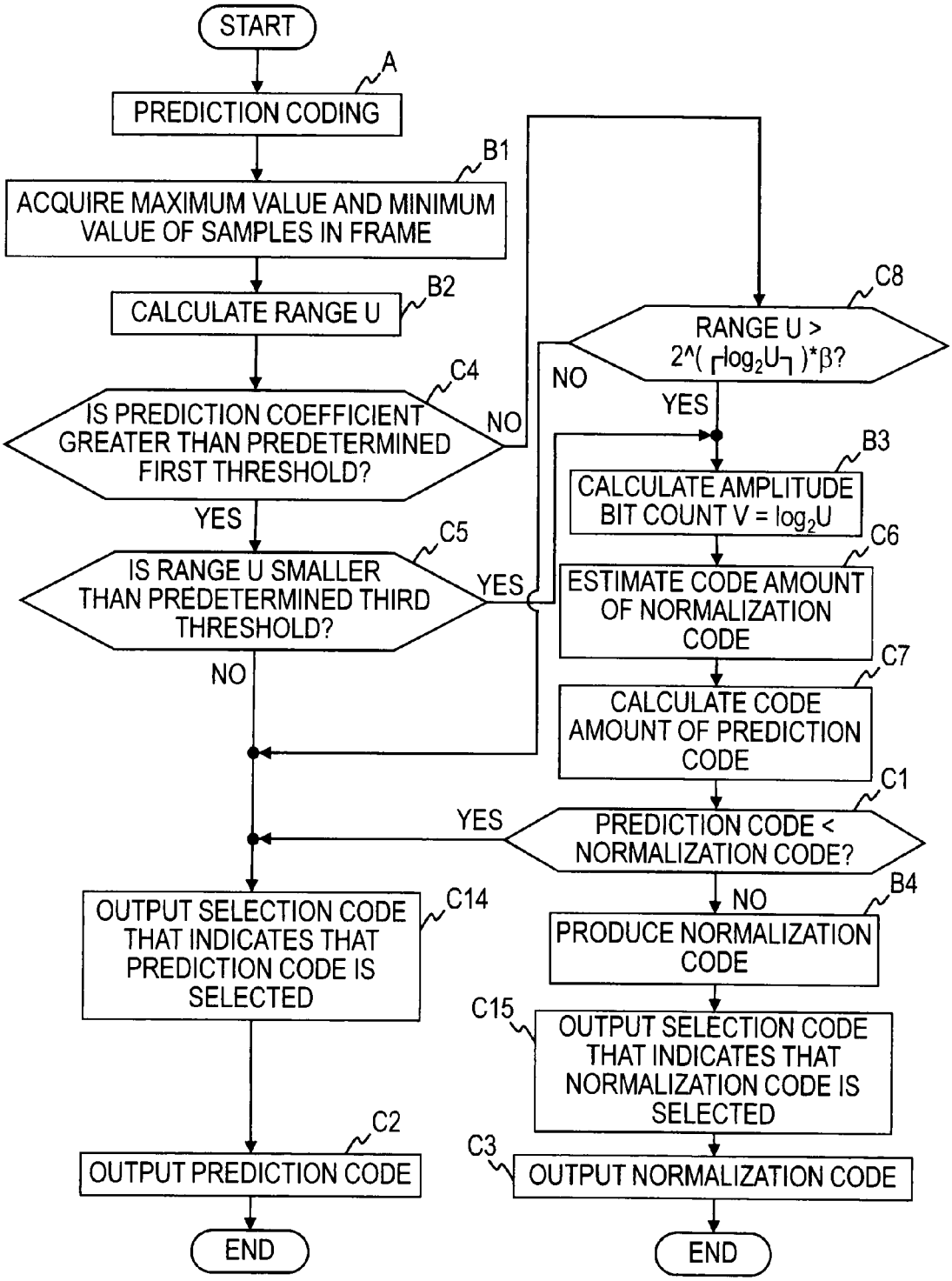
FIG. 15 is a flow chart showing an exemplary coding method according to a fourth embodiment.

The functional blocks of a coding apparatus according to the fourth embodiment are the same as the functional blocks of the coding apparatus according to the third embodiment illustrated in FIG. 3. FIG. 15 shows an exemplary coding process according to the fourth embodiment. The fourth embodiment differs from the third embodiment in that a range comparing part 83 and a selection result output part 82 further perform a determination processing in Sub-Step C8 shown in FIG. 15, but is the same as the third embodiment in the other respects. In the following, the difference from the third embodiment will be described.

The range comparing part 83 compares the range U with $2\hat{}(\lceil \log_2 U \lceil)*\beta$ (Sub-Step C8). The comparison result is passed to the selection result output part 82. The symbol $\lceil \bullet \rceil$ represents the smallest integer equal to or greater than •, and β represents a positive constant equal to or smaller than 1 and is appropriately set based on the required performance, specification or the like.

If the prediction coefficient is smaller than a predetermined first threshold, and the range U is equal to or smaller than $2\hat{}(\lceil \log_2 U \rceil)*\beta$, the selection result output part 82 outputs a selection code that indicates to select the prediction coding method (Sub-Step C14). In addition, the selection result output part 82 turns off a switch d3 and turns on a switch d4. By this operation, the prediction code is output (Sub-Step C2).

If the prediction coefficient is smaller than the predetermined first threshold, and the range U is greater than $2\hat{}(\lceil \log_2 U \rceil)*\beta$ the selection result output part 82 turns on switches d5 and d6 and performs the processing in Sub-Step B3 and the following processings.

As described above, since the coding method that provides the smaller code amount is selected based on data produced in the course of prediction coding by the prediction coding part 2 and/or data produced in the course of normalization coding by the normalization coding part 3, the prediction coding method and the normalization coding method do not have to be performed in their entirety, and thus, the calculation amount is reduced.

Fifth Embodiment

In the case where the prediction coding method is to select one of the short-term prediction and the long-term prediction that provides the smaller code amount for each frame, the prediction effect is higher when the long-term prediction is selected. In this case, the code amount of a prediction code is smaller than the code amount of a normalization code in most cases. A fifth embodiment takes advantage of this property, and the prediction coding method is selected if the long-term prediction is selected.

Figure 4:
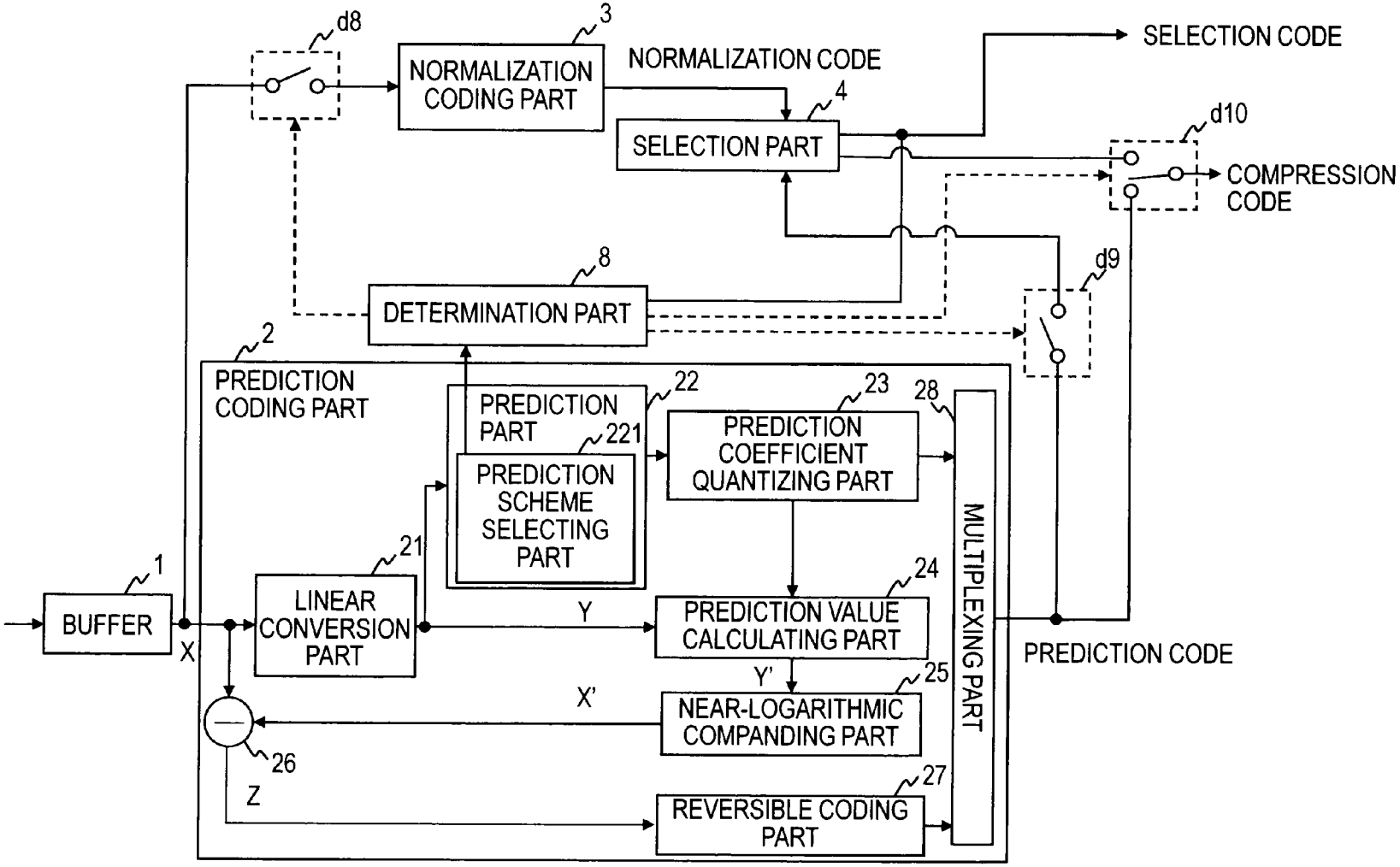
FIG. 4 is a functional block diagram showing an exemplary coding apparatus according to a fifth embodiment.
Figure 16:
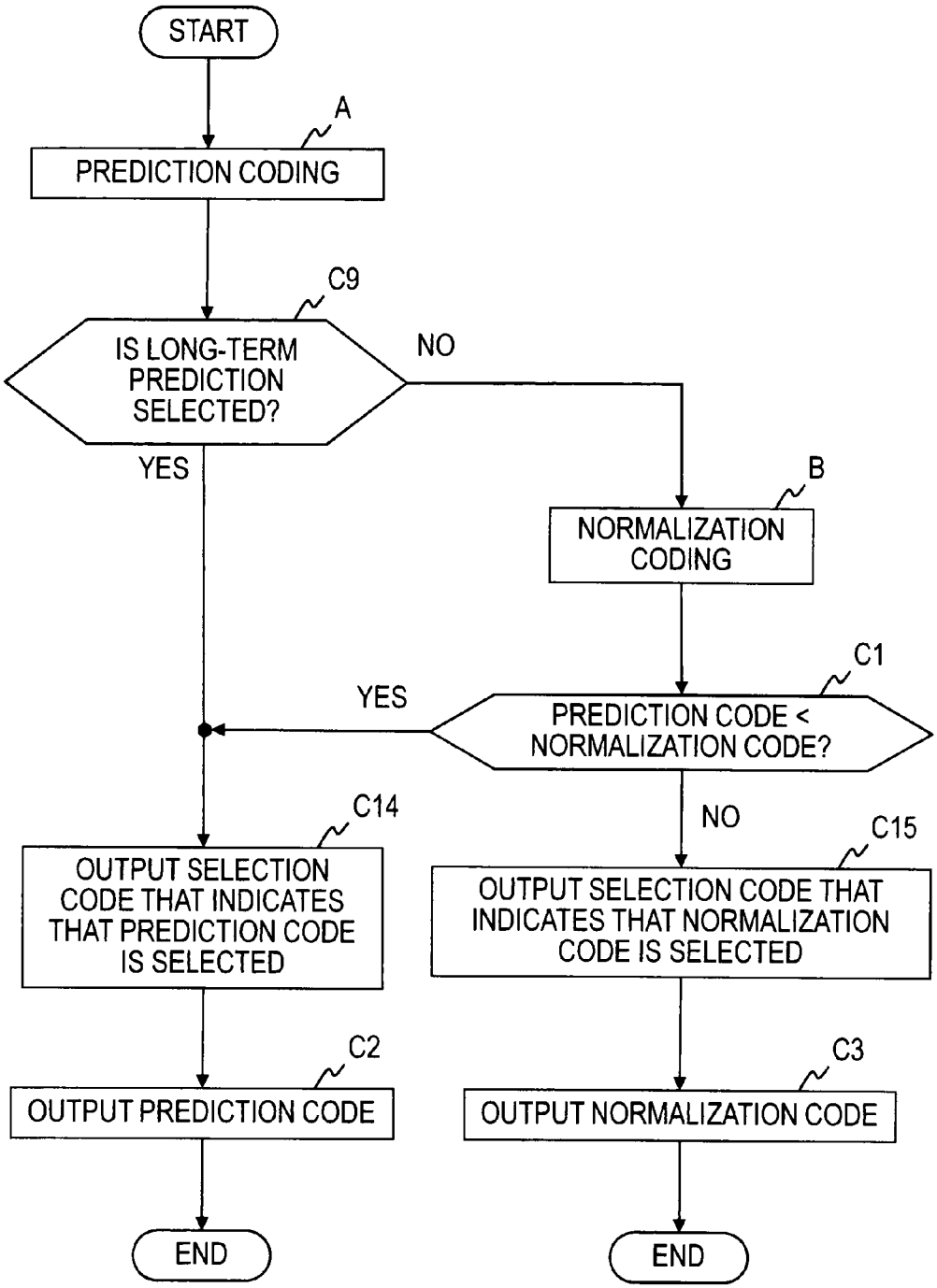
FIG. 16 is a flow chart showing an exemplary coding method according to the fifth embodiment.

FIG. 4 is a functional block diagram showing an exemplary coding apparatus according to the fifth embodiment. FIG. 16 is a flow chart showing an exemplary coding method according to the fifth embodiment.

A prediction part 22 includes a prediction scheme selecting part 221. For each frame, the prediction scheme selecting part 221 selects the prediction scheme that provides the smaller code amount between among the short-term prediction and the long-term prediction. For example, the prediction scheme selecting part 221 selects the prediction scheme that provides the smaller code amount by determining which is smaller: the amount of codes produced by short-term prediction of the samples in a frame or the amount of codes produced by long-term prediction of the samples in the same frame.

If the short-term prediction is selected, the prediction part 22 calculates a prediction coefficient for the short-term prediction and passes the prediction coefficient to a prediction coefficient quantizing part 23. If the long-term prediction is selected, the prediction part 22 calculates a prediction coefficient for the long-term prediction and passes the prediction coefficient to the prediction coefficient quantizing part 23. Information on the selected prediction scheme is passed to a determination part 8.

The determination part 8 determines whether or not the selected prediction scheme is the long-term prediction (Sub-Step C9). If the selected prediction scheme is the long-term prediction, the determination part 8 turns off switches d8 and d9 and connects a switch d10 to a prediction coding part 2, thereby outputting a selection code that indicates to select the prediction coding method along with the prediction code produced in Step A (Sub-Steps C2, C14).

If the selected prediction scheme is the short-term prediction, the determination part 8 turns on the switches d8 and d9 and connects the switch d10 to a selection part 4. The selection part 4 compares the normalization code produced in Step B by a normalization coding part 3 and the prediction code produced in Step A by the prediction coding part 2 (Sub-Step C1) and outputs the code that provides the smaller code amount as a compression code along with the selection code (Sub-Steps C2, C14, C3, C15).

As described above, since the coding method that provides the smaller code amount is selected based on data produced in the course of prediction coding by the prediction coding part 2 (information that indicates that the long-term prediction is selected, in this embodiment), the prediction coding method and the normalization coding method do not have to be performed in their entirety, and thus, the calculation amount is reduced.

Sixth Embodiment

As is known, the performance of the prediction coding method is low if many of the samples in a frame assume positive values or negative values, that is, the values of the samples in a frame are biased to the positive or negative side, and the performance of the prediction coding method is high if the bias is small. A sixth embodiment takes advantage of this property, and the prediction coding method is selected if the bias of the values of the samples in a frame to the positive or negative side is small.

Figure 5:
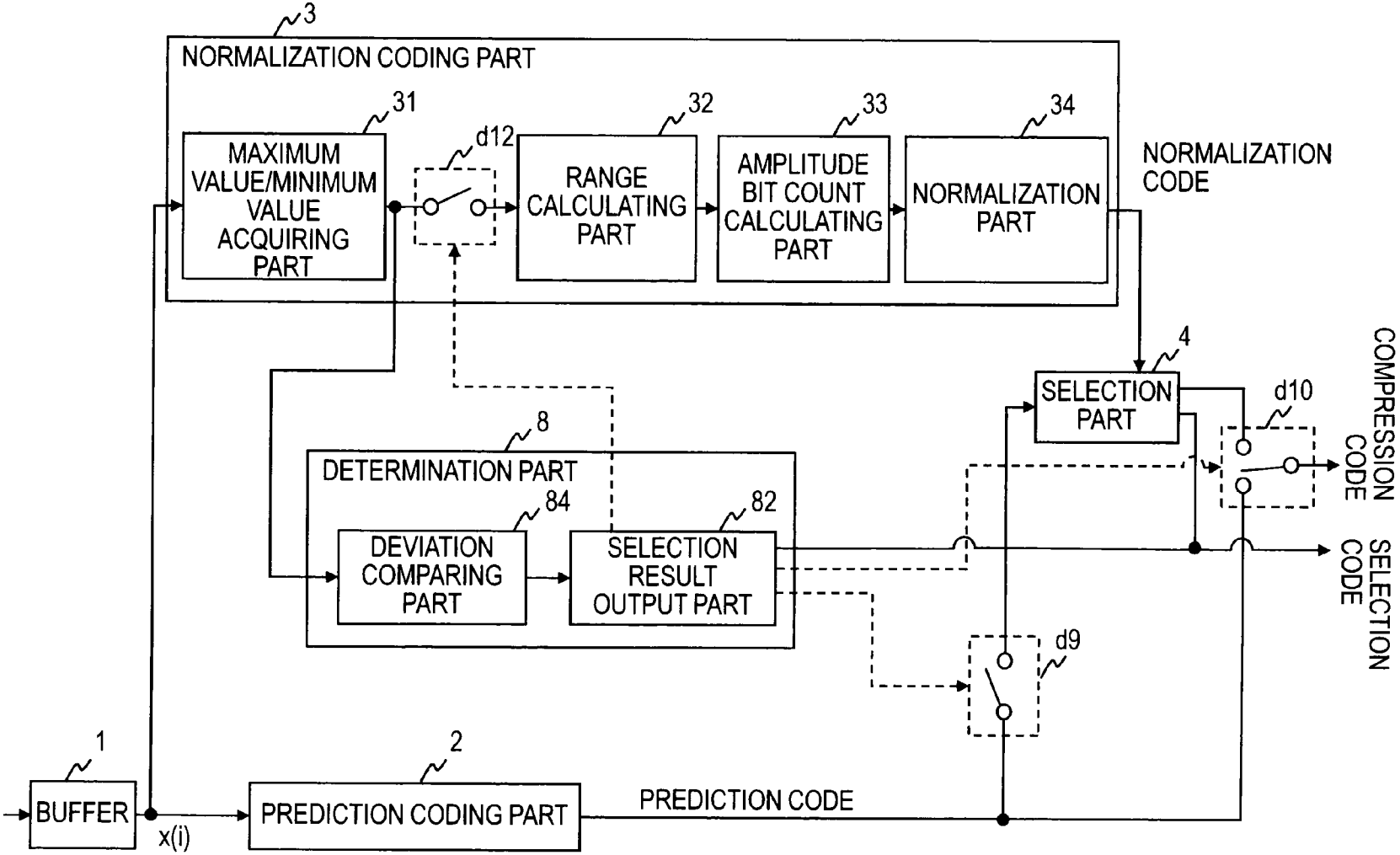
FIG. 5 is a functional block diagram showing an exemplary coding apparatus according to a sixth embodiment.
Figure 17:
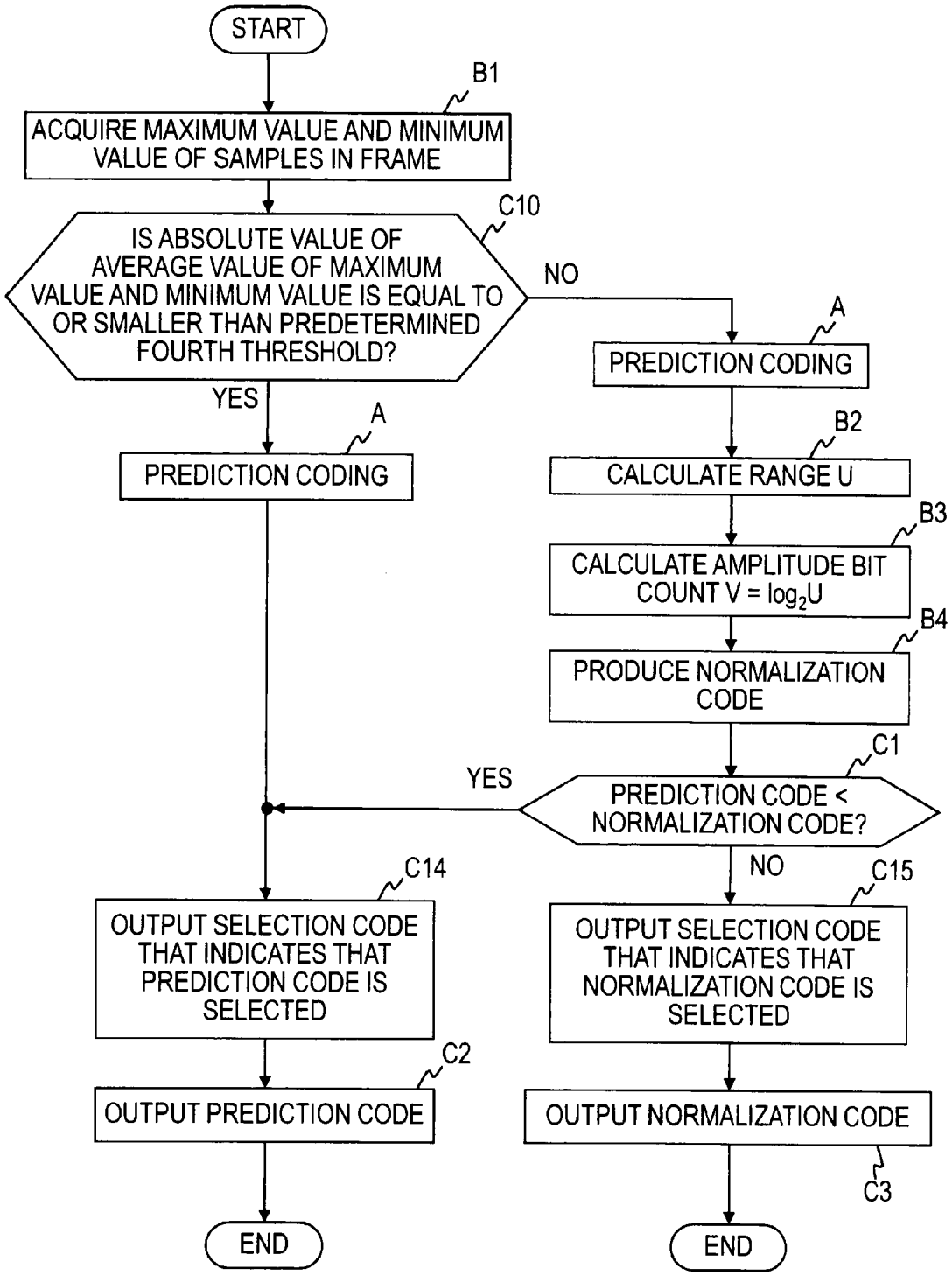
FIG. 17 is a flow chart showing an exemplary coding method according to the sixth embodiment.

FIG. 5 is a functional block diagram showing an exemplary coding apparatus according to the sixth embodiment. FIG. 17 is a flow chart showing an exemplary coding method according to the sixth embodiment.

A maximum value/minimum value acquiring part 31 acquires the maximum value and the minimum value from the values of the samples in the frame and passes the maximum and minimum values to a determination part 8 (Sub-Step B1).

The determination part 8 includes a deviation comparing part 84 and a selection result output part 82.

The deviation comparing part 84 compares the absolute value of an average value of the maximum value and the minimum value of the samples in the frame with a fourth threshold (Sub-Step C10). The comparison result is passed to the selection result output part 82. The fourth threshold is a predetermined constant and is appropriately set based on the required performance, specification or the like.

If the absolute value is smaller than the fourth threshold, the selection result output part 82 outputs a selection code that indicates to select the prediction coding method along with a prediction code produced in Step A by a prediction coding part 2. Specifically, the selection result output part 82 turns off switches d12 and d9 and connects a switch d10 to the prediction coding part 2. By this operation, the prediction code produced by the prediction coding part 2 is output as a compression code.

If the absolute value is equal to or greater than the fourth threshold, the selection result output part 82 turns on the switches d12 and d9 and connects the switch d10 to a selection part 4. The following processings are the same as those in the first embodiment. That is, the prediction coding part 2 produces the prediction code (Step A), a normalization coding part 3 produces a normalization code (Sub-Steps B2 to B4), and the selection part 4 compares the code amount of the prediction code and the code amount of the normalization code (Sub-Step C1), selects the coding method that provides the smaller code amount, and outputs the code produced according to the selected coding method along with the selection code (Sub-Steps C2, C3, C14, C15).

Note that the maximum value/minimum value acquiring part 31 (Sub-Step B1) may be omitted, and the deviation comparing part 84 may compare the absolute value of the average of the values of all the samples in the frame with the fourth threshold. Alternatively, the maximum value/minimum value acquiring part 31 may acquire the number of samples that assume positive values in the frame and the number of samples that assume negative values in the frame, instead of the maximum value and the negative value of the values of the samples in the frame, and the deviation comparing part 84 may compare the absolute value of the difference between the number of samples that assume positive values in the frame and the number of samples that assume negative values in the frame with the fourth threshold. In short, it is essential only that an evaluation value that indicates the degree of the bias of the samples in the frame, such as the absolute values described above, is determined, and the prediction coding method is selected if the evaluation value is smaller than the fourth threshold.

As described above, since the coding method that provides the smaller code amount is selected based on data produced in the course of normalization coding by the normalization coding part 3 (the maximum value and the minimum value of the samples, for example, in this embodiment), the prediction coding method and the normalization coding method do not have to be performed in their entirety, and thus, the calculation amount is reduced.

Seventh Embodiment

If the difference between the maximum value and the minimum value of the samples in a frame is 1, the normalization coding method can code each sample with 1 bit. However, when the difference between the maximum value and the minimum value is 1, the prediction coding method requires at least 1 bit to code the error for each sample and further requires auxiliary information, such as a prediction coefficient. Therefore, if the difference between the maximum value and the minimum value is 1, the code amount of the normalization code is always smaller than the code amount of the prediction code, so that the comparison between the code amount of the normalization code and the code amount of the prediction code is not necessary. A seventh embodiment takes advantage of this property, and the normalization code is selected if the difference between the maximum value and the minimum value of the samples in a frame is 1.

Figure 6:
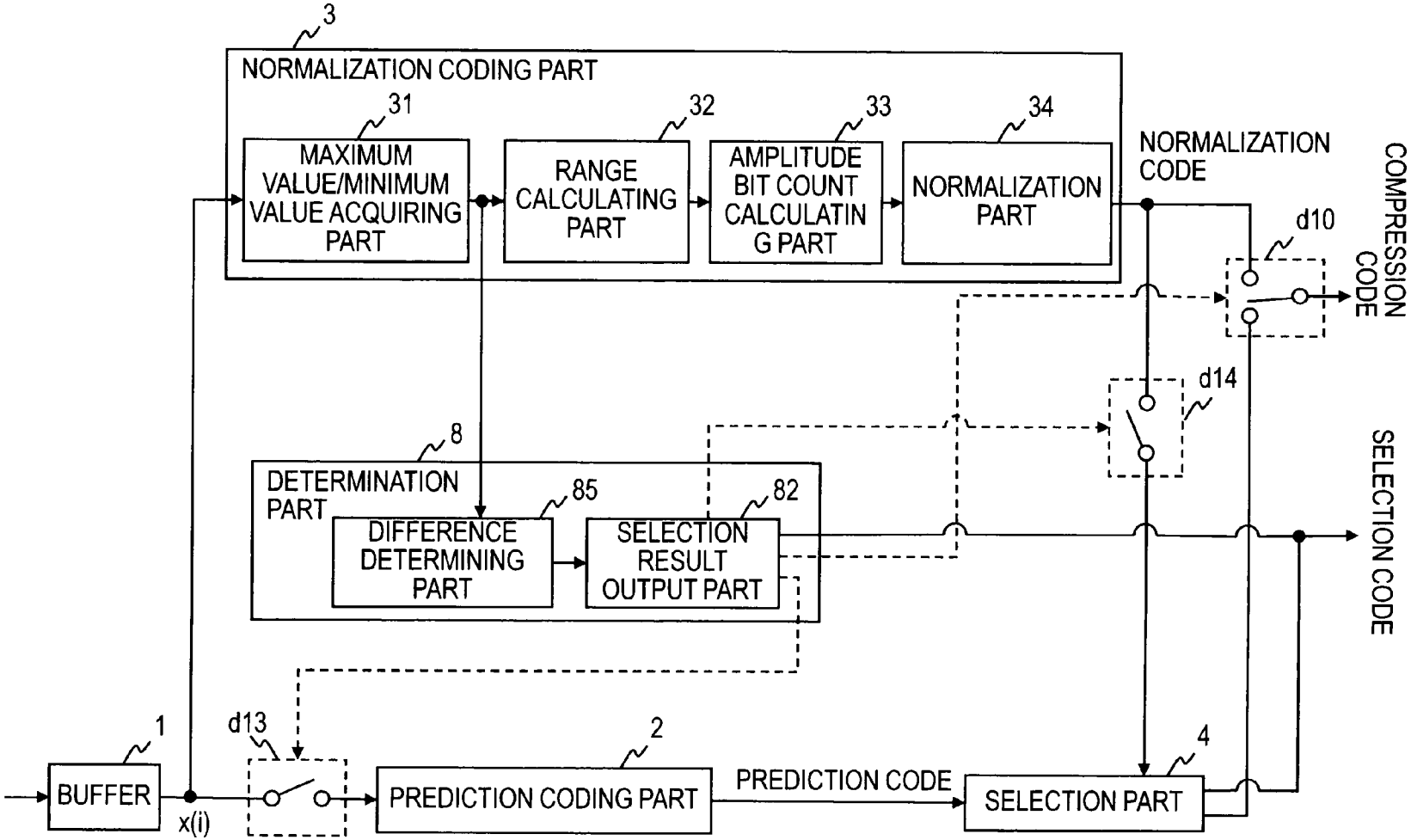
FIG. 6 is a functional block diagram showing an exemplary coding apparatus according to a seventh embodiment.
Figure 18:
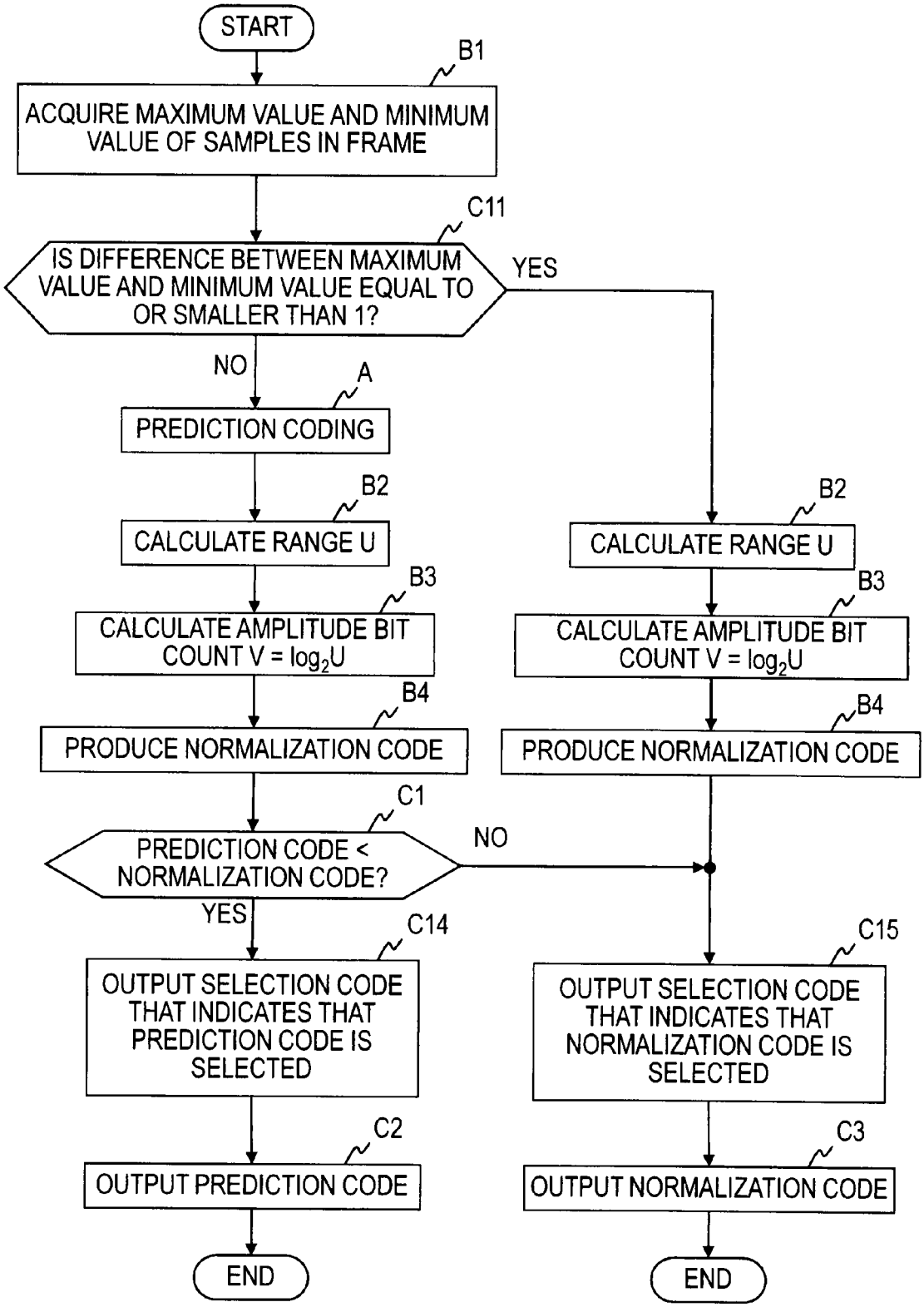
FIG. 18 is a flow chart showing an exemplary coding method according to the seventh embodiment.

FIG. 6 is a functional block diagram showing an exemplary coding apparatus according to the seventh embodiment. FIG. 18 is a flow chart showing an exemplary coding method according to the seventh embodiment.

A maximum value/minimum value acquiring part 31 acquires the maximum value and the minimum value from the values of the samples in the frame and passes the maximum and minimum values to a determination part 8 (Sub-Step B1).

The determination part 8 includes a difference determining part 85 and a selection result output part 82.

The difference determining part 85 determines whether or not the difference between the maximum value and the minimum value of the samples in the frame is 1 (Sub-Step C11). The determination result is passed to the selection result output part 82.

If the difference between the maximum value and the minimum value is 1, the selection result output part 82 outputs a selection code that indicates to select the normalization coding method along with a normalization code produced by a normalization coding part 3 in Sub-Steps B2 to B4 (Sub-Steps C3, C14). Specifically, the selection result output part 82 turns off a switch d12, turns off switches d13 and 14, and connects a switch d10 to the normalization coding part 3. By this operation, the normalization code produced by the normalization coding part 3 is output as a compression code.

If the difference between the maximum value and the minimum value is not 1, the selection result output part 82 turns on the switches d13 and d14 and connects the switch d10 to a selection part 4. The following processings are the same as those in the first embodiment. That is, the prediction coding part 2 produces the prediction code (Step A), the normalization coding part 3 produces the normalization code (Sub-Steps B2 to B4), and the selection part 4 compares the code amount of the prediction code and the code amount of the normalization code (Sub-Step C1), selects the coding method that provides the smaller code amount, and outputs the code produced according to the selected coding method along with the selection code (Sub-Steps C2, C3, C14, C15).

As described above, since the coding method that provides the smaller code amount is selected based on data produced in the course of normalization coding by the normalization coding part 3 (the maximum value and the minimum value of the samples, in this embodiment), the prediction coding method and the normalization coding method do not have to be performed in their entirety, and thus, the calculation amount is reduced.

Eighth Embodiment

According to an eighth embodiment, the code amount of a prediction code is estimated based on a prediction error calculated in the course of prediction coding, the code amount of a normalization code is estimated based on a range U calculated in the course of normalization coding, and the coding method that provides the smaller code amount is selected based on comparison between the estimate code amounts.

Figure 7:
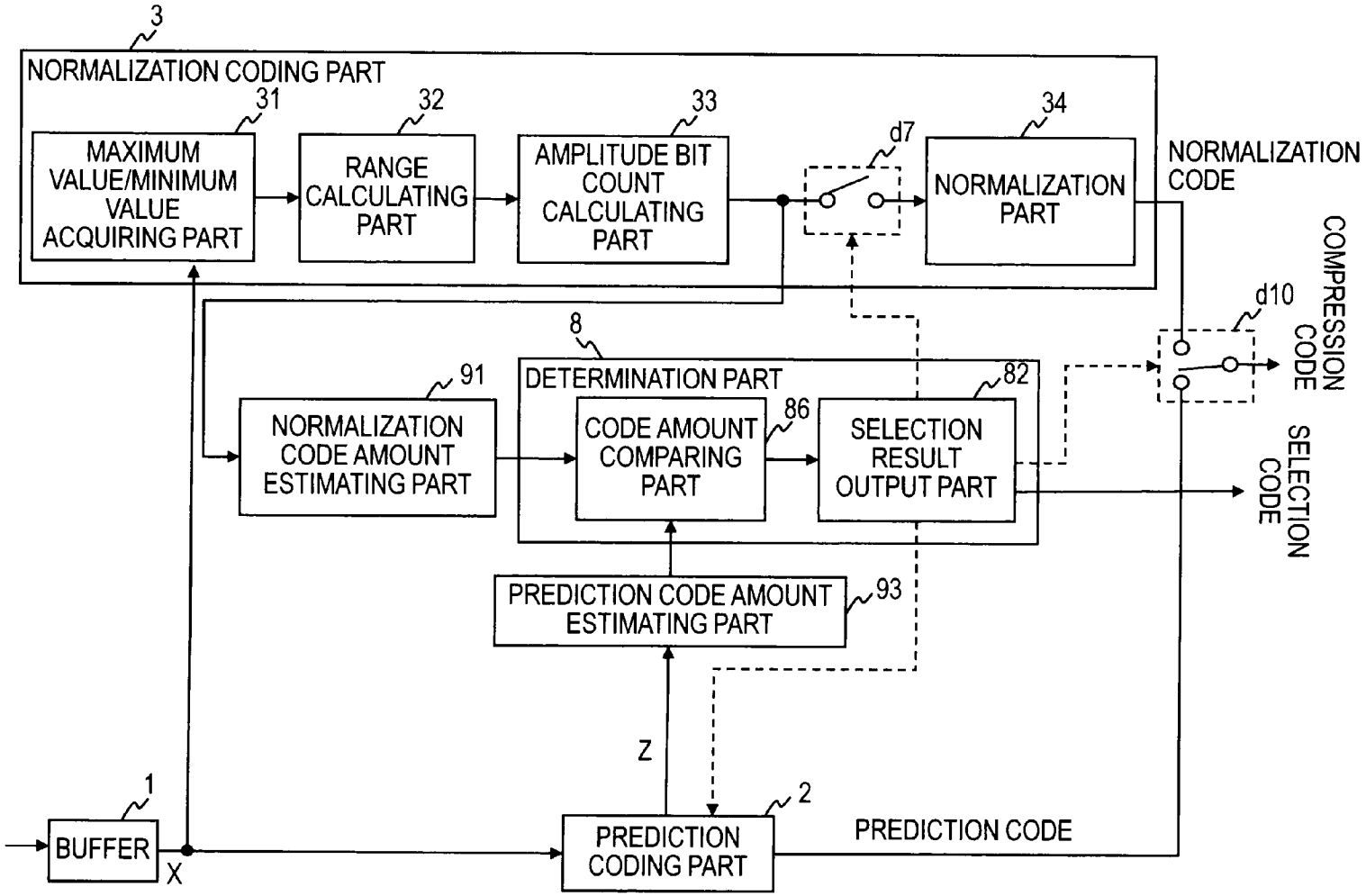
FIG. 7 is a functional block diagram showing an exemplary coding apparatus according to an eighth embodiment.
Figure 19:
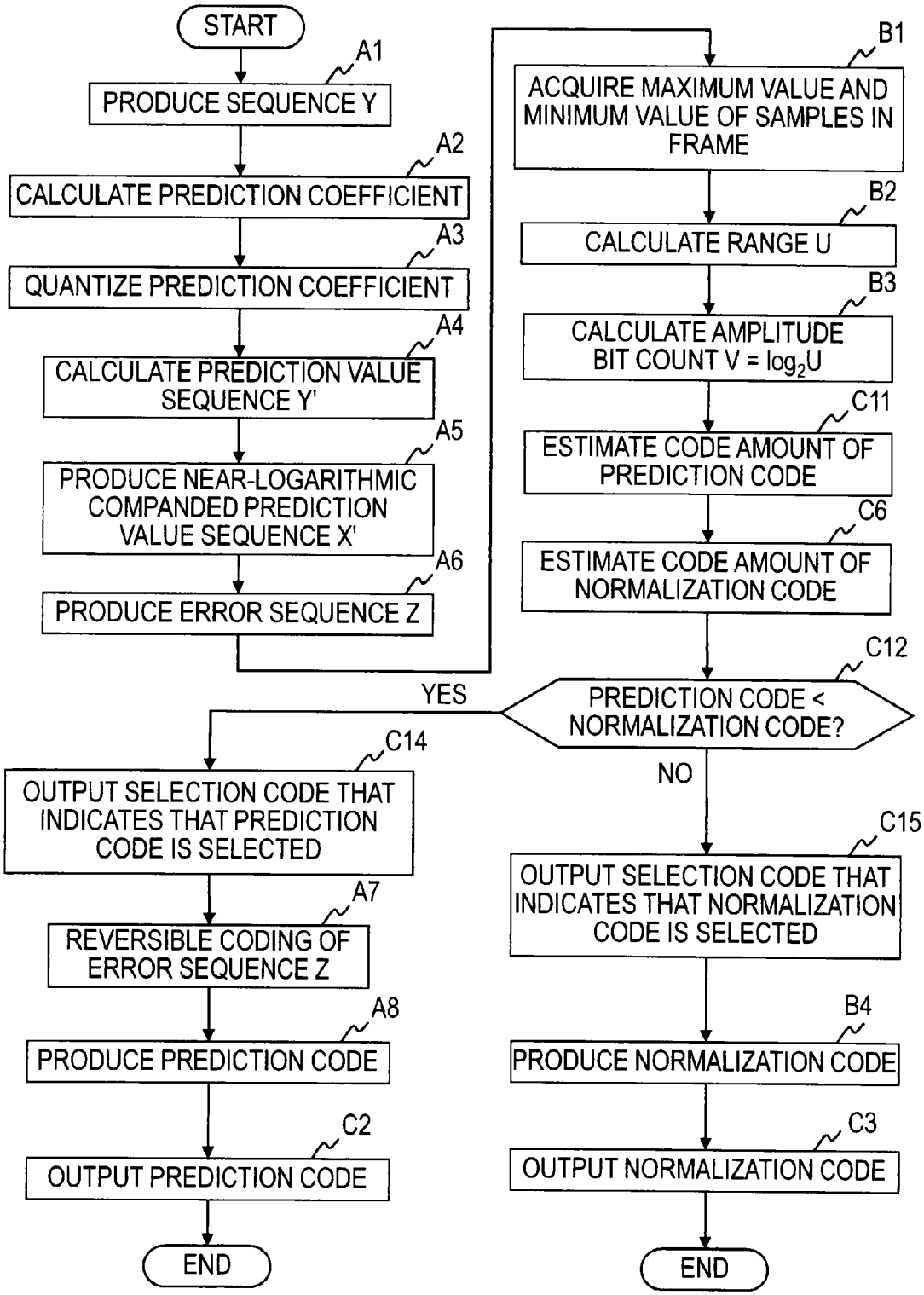
FIG. 19 is a flow chart showing an exemplary coding method according to the eighth embodiment.

FIG. 7 is a functional block diagram showing an exemplary coding apparatus according to the eighth embodiment, and FIG. 19 is a flow chart showing an exemplary coding method according to the eighth embodiment.

As in the first embodiment, a prediction coding part 2 produces an error sequence Z (Sub-Steps A1 to A6). The produced error sequence Z is passed to a prediction code amount estimating part 93. As in the first embodiment, a normalization coding part 3 calculates an amplitude bit count V. The calculated amplitude bit count V is passed to a normalization code amount estimating part 91.

The prediction code amount estimating part 93 estimates the code amount of the prediction code based on the error sequence Z (Sub-Step C11). The estimated code amount of the prediction code is passed to a determination part 8. If codes with smaller values are assigned to errors with smaller absolute values in reversible coding of the error sequence Z, the code amount of the prediction code can be estimated as $\Sigma_{i=1}^{N}(2|z(i)|+1)$, for example, where N represents the number of samples in a frame.

The normalization code amount estimating part 91 estimates the code amount of the normalization code using the amplitude bit count Z (Sub-Step C6). For example, the number of bytes W per frame of the normalization code is estimated according to W=NV/8+2, where N represents the number of samples in a frame. The estimated number of bytes W is regarded as the estimated normalization code amount. The estimated normalization code amount is passed to the determination part 8.

The determination part 8 includes a code amount comparing part 86 and a selection result output part 82.

The code amount comparing part 86 compares the estimated code amount of the prediction code and the estimated code amount of the normalization code (Sub-Step C12). The comparison result is passed to the selection result output part 82.

If the estimated code amount of the prediction code is smaller than the estimated code amount of the normalization code, the selection result output part 82 outputs a selection code that indicates to select the prediction coding method (Sub-Step C14). The prediction code is produced through Sub-Steps A7 to A8, and the selection result output part 82 connects a switch d10 to the prediction coding part 2. By this operation, the prediction code is output as a compression code (Sub-Step C2).

If the estimated code amount of the normalization code is smaller than the estimated code amount of the prediction code, the selection result output part 82 outputs a selection code that indicates to select the normalization coding method (Sub-Step C14). The normalization code is produced through Sub-Step B4, and the selection result output part 82 turns on a switch d7 and connects the switch d10 to the normalization coding part 3. By this operation, the normalization code is output as a compression code (Sub-Step C3).

As described above, since the coding method that provides the smaller code amount is selected based on data produced in the course of prediction coding by the prediction coding part 2 (the prediction error, in this embodiment) and data produced in the course of normalization coding by the normalization coding part 3 (the range U, in this embodiment), the prediction coding method and the normalization coding method do not have to be performed in their entirety, and thus, the calculation amount is reduced.

<<Decoding Apparatus and Decoding Method>>

Figure 8:
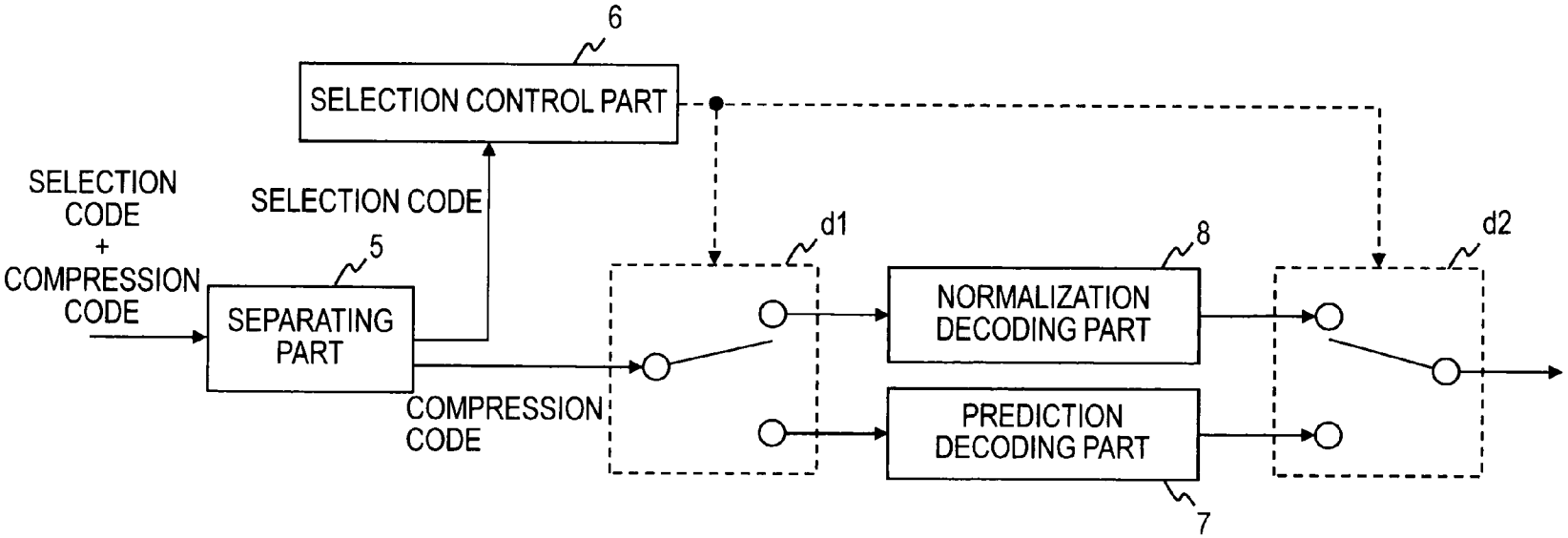
FIG. 8 is a functional block diagram showing an exemplary modification of the coding apparatus according to the second embodiment.
Figure 20:
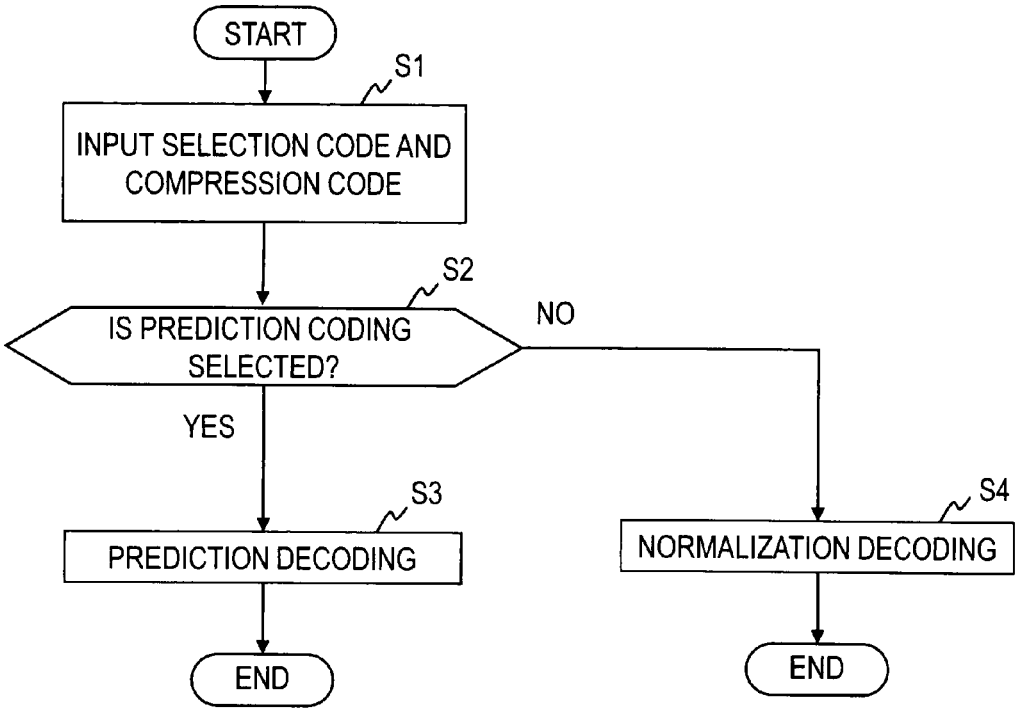
FIG. 20 is a flow chart showing an exemplary decoding method.
Figure 21:
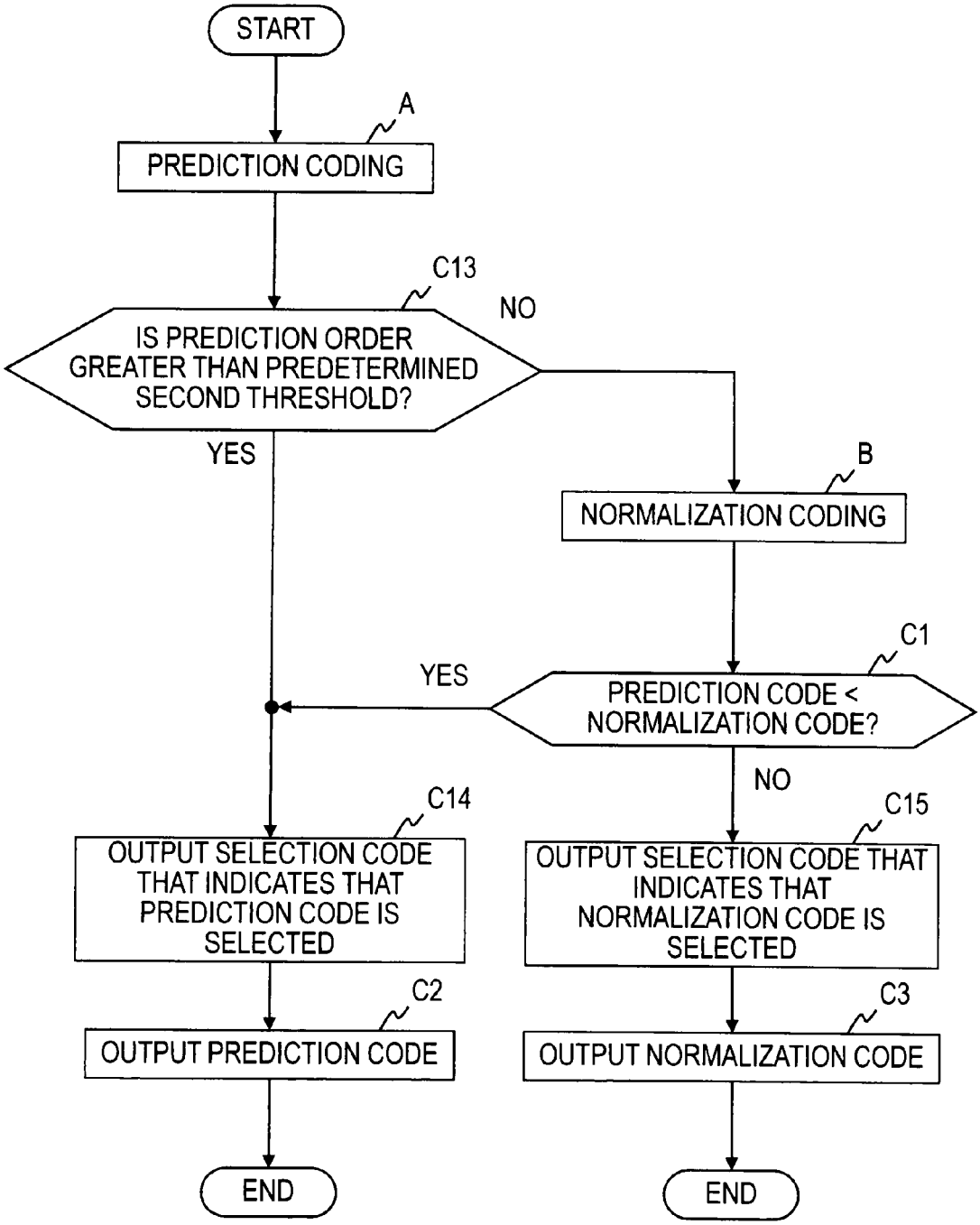
FIG. 21 is a flow chart showing an exemplary modification of the coding method according to the second embodiment.

FIG. 8 is a functional block diagram showing an exemplary decoding apparatus. FIG. 20 is a flow chart showing an exemplary decoding method.

A selection code and a compression code are input to the decoding apparatus (Sub-Step S1). The decoding apparatus comprises a separating part 5, a selection control part 6, a prediction decoding part 7, a normalization decoding part 9, and switches d1 and d2.

The separating part 5 separates the selection code and the compression code from each other, and passes the selection code to the selection control part 6 and the compression code to the switch d1.

The selection control part 6 selectively makes the prediction decoding part 7 or the normalization decoding part 9 that is responsible for decoding corresponding to the coding method specified by the selection code decode the compression code. That is, the selection control part 6 checks the coding method specified by the selection code (Sub-Step S2), and connects switches d1 and d2 to the prediction decoding part 7 if the selection code specifies the prediction coding method. In this case, the prediction decoding part 7 decodes the compression code according to the decoding method corresponding to the prediction coding method previously performed (Sub-Step S3).

On the other hand, if the selection code specifies the normalization coding method, the selection control part 6 connects the switches d1 and d2 to the normalization decoding part 9. In this case, the normalization decoding part 9 decodes the compression code according to the decoding method corresponding to the normalization coding method previously performed (Sub-Step S4).

[Modifications]

In the second, third, and fourth embodiments, the coding method that provides the smaller code amount is selected based on the prediction coefficient. However, in the case where the prediction order is adaptively selected on a frame basis, the coding method that provides the smaller code amount may be selected based on the prediction order, instead of the prediction coefficient. More specifically, the coding method that provides the smaller code amount is selected based on comparison between the prediction order and a predetermined second threshold, rather than comparison between the prediction coefficient and the predetermined first threshold. This is because there is a positive correlation between the prediction coefficient and the prediction order, and therefore, the prediction order generally increases with the prediction coefficient.

For example, in the second embodiment, the prediction part 22 (FIG. 9) calculates prediction coefficients corresponding to a plurality of predetermined prediction orders. Based on the calculated prediction coefficients, the prediction part 22 selects the prediction order for which the code amount is at the minimum. The selected prediction order is passed to the prediction coefficient quantizing part 23 along with the prediction coefficient. The prediction order and the prediction coefficient are quantized and passed to the multiplexing part 28 and the prediction value calculating part 24. The quantized prediction order is also passed to the determination part 8.

Figure 9:
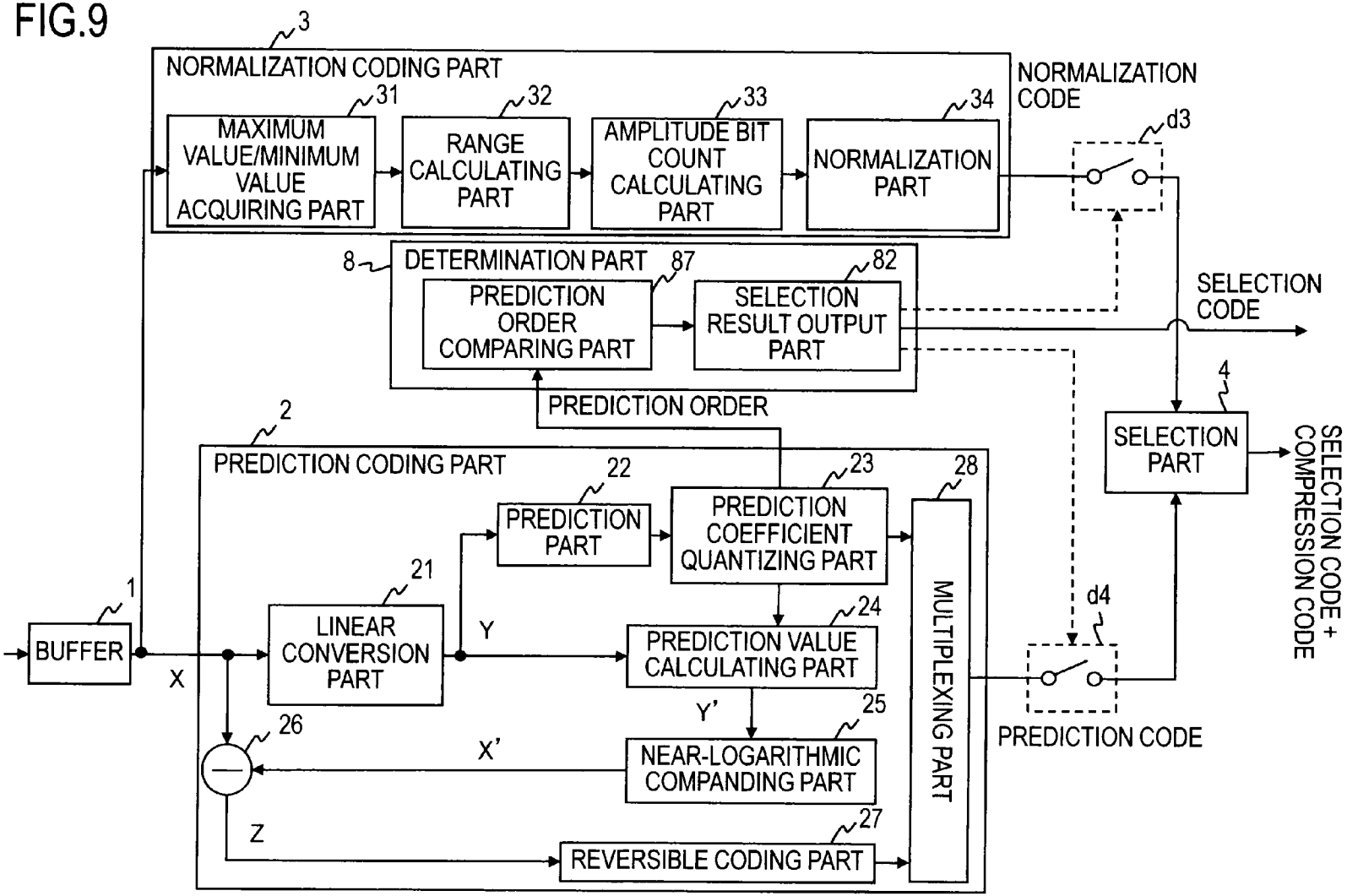
FIG. 9 is a functional block diagram showing an exemplary decoding apparatus.

As illustrated in FIG. 9, the determination part 8 includes a prediction order comparing part 87 and the selection result output part 82.

The prediction order comparing part 87 compares the prediction order with the predetermined second threshold (Sub-Step C13), and passes the comparison result to the selection result output part 82. The second threshold is appropriately set based on the performance, specification or the like.

If the prediction order is greater than the predetermined threshold, the selection result output part 82 selects the prediction coding method and outputs a selection code that indicates that the prediction coding method is selected. The following processings are the same as those in the second embodiment. The processings in the case where the prediction order is smaller than the predetermined threshold is also the same as the processings in the case where the prediction coefficient is smaller than the predetermined threshold described above with regard to the second embodiment.

The coding apparatus and the decoding apparatus can be implemented by a computer. The specific processing capabilities of the apparatuses are described in a program. A computer can execute the program to implement the specific processing capabilities of the apparatuses.

The program that describes the processing capabilities can be recorded in a computer-readable recording medium. Although the apparatuses are implemented by a computer executing a predetermined program in the embodiments described above, at least part of the processing capabilities may be implemented in the form of hardware.

The present invention is not limited to the embodiments described above but can be modified as required without departing form the spirit of the present invention.

What is claimed is:

1. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a prediction coefficient producing sub-step of producing one or more prediction coefficients used for the linear prediction from the samples in the frame;

a range calculating sub-step of calculating a range U based on values of all samples in the frame; and a selection result output sub-step of outputting the selection code that indicates to select the prediction coding method, if any one of the prediction coefficients is greater than a predetermined first threshold, and the range U is greater than a predetermined third threshold.

2. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a prediction order producing sub-step of producing a prediction order used for the linear prediction from the samples in the frame;

a range calculating sub-step of calculating a range U based on values of all samples in the frame; and a selection result output sub-step of outputting the selection code that indicates to select the prediction coding method, if the prediction order is greater than a predetermined second threshold, and the range U is greater than a predetermined third threshold.

3. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a prediction coefficient producing sub-step of producing one or more prediction coefficients used for the linear prediction from the samples in the frame; and a selection result output sub-step of outputting a selection code that indicates to select the prediction coding method, if any one of the one or more prediction coefficients is greater than a predetermined first threshold.

4. The coding method according to claim 3, wherein the selection step comprises:

a range calculating sub-step of calculating a range U based on values of all samples in the frame; and a selection result output sub-step of outputting the selection code that indicates to select the prediction coding method if the range U is smaller than a value calculated by $2^{(\lceil \log_2 U \rceil)\beta}$ where β represents a positive constant equal to or smaller than 1, even if any one of the prediction coefficients is smaller than the predetermined first threshold.

5. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a prediction order producing sub-step of producing a prediction order used for the linear prediction from the samples in the frame; and a selection result output sub-step of outputting a selection code that indicates to select the prediction coding method, if the prediction order is greater than a predetermined second threshold.

6. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a prediction scheme selecting sub-step of selecting a prediction scheme that provides a smaller code amount between a short-term prediction and a long-term prediction for each frame; and a selection result output sub-step of outputting a selection code that indicates to select the prediction coding method, if the long-term prediction is selected in the prediction scheme selecting sub-step.

7. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a selection result output sub-step of outputting a selection code that indicates to select the prediction coding method, if an evaluation value that indicates a deviation of the samples in the frame is smaller than a predetermined fourth threshold.

8. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a selection result output sub-step of outputting a selection code that indicates to select the normalization coding method, if it is determined that the difference between a maximum value and a minimum value of the samples in the frame is 1.

9. A coding method, comprising:

a selection step of selecting a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and outputting a selection code that indicates the selection result; and a coding step of coding the samples in the frame according to the selected coding method to produce a compression code, wherein the selection step comprises:

a prediction error calculating sub-step of calculating a prediction error;

a prediction code amount estimating sub-step of estimating the amount of prediction code produced by the prediction coding method, using the prediction error;

a range calculating sub-step of calculating a range U based on values of all samples in the frame;

an amplitude bit count calculating sub-step of calculating an amplitude bit count V using the range U according to $V=\log_2 U$;

a normalization code amount estimating sub-step of estimating the amount of normalization code produced by the normalization coding method using the amplitude bit count V; and a selection result output sub-step of outputting a selection code that indicates to select the coding method that produces the smaller code amount between the prediction coding and the normalization coding based on the estimated amount of prediction code and the estimated amount of normalization code.

10. A coding method, comprising:

a prediction coefficient producing step of producing one or more prediction coefficients used for linear prediction from samples in a frame;

a range calculating step of calculating a range U based on values of all samples in the frame;

a selection result output step of outputting a selection code that indicates to select a prediction coding method that performs linear prediction of the samples in the frame and codes an amplitude of a prediction error, if any one of the prediction coefficients is greater than a predetermined first threshold, and the range U is greater than a predetermined third threshold; and a coding step of coding the sample in the frame according to the selected coding method to produce a compression code.

11. The coding method according to claim 10, further comprising:

a selection step of selecting a coding method that produces a smaller code amount between the prediction coding method and a normalization coding method that normalizes an amplitude of the samples in the frame and codes the normalized amplitude and outputting a selection code that indicates the selection result, even if any one of the prediction coefficients is smaller than the predetermined first threshold, or if the range U is smaller than the predetermined third threshold even if any one of the prediction coefficients is greater than the predetermined first threshold.

12. A coding apparatus, comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a prediction coefficient producing sub-step of producing one or more prediction coefficients used for the linear prediction from the samples in the frame;

a range calculating sub-step of calculating a range U based on values of all samples in the frame; and a selection result output sub-step of outputting the selection code that indicates to select the prediction coding method, if any one of the prediction coefficients is greater than a predetermined first threshold, and the range U is greater than a predetermined third threshold.

13. A coding apparatus comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a prediction order producing sub-step of producing a prediction order used for the linear prediction from the samples in the frame;

a range calculating sub-step of calculating a range U based on values of all samples in the frame; and a selection result output sub-step of outputting the selection code that indicates to select the prediction coding method, if the prediction order is greater than a predetermined second threshold, and the range U is greater than a predetermined third threshold.

14. A coding apparatus, comprising:

a computer processor configured to:

produce one or more prediction coefficients used for the linear prediction from the samples in the frame;

calculate a range U based on values of all samples in the frame;

output a selection code that indicates to select a prediction coding method that performs linear prediction of the samples in the frame and codes an amplitude of a prediction error, if any one of the prediction coefficients is greater than a predetermined first threshold, and the range U is greater than a predetermined third threshold; and code the samples in the frame according to the selected coding method to produce a compression code.

15. The coding apparatus according to claim 14, wherein the computer processor selects a coding method that produces a smaller code amount between the prediction coding method and a normalization coding method that normalizes an amplitude of the samples in the frame and codes the normalized amplitude and outputs a selection code that indicates the selection result, even if any one of the prediction coefficients is smaller than the predetermined first threshold, or if the range U is smaller than the predetermined third threshold even if any one of the prediction coefficients is greater than the predetermined first threshold.

16. A coding apparatus, comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a prediction coefficient producing sub-step of producing one or more prediction coefficients used for the linear prediction from the samples in the frame; and a selection result output sub-step of outputting a selection code that indicates to select the prediction coding method, if any one of the one or more prediction coefficients is greater than a predetermined first threshold.

17. A coding apparatus, comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a prediction order producing sub-step of producing a prediction order used for the linear prediction from the samples in the frame; and a selection result output sub-step of outputting a selection code that indicates to select the prediction coding method, if the prediction order is greater than a predetermined second threshold.

18. A coding apparatus, comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a prediction scheme selecting sub-step of selecting a prediction scheme that provides a smaller code amount between a short-term prediction and a long-term prediction for each frame; and a selection result output sub-step of outputting a selection code that indicates to select the prediction coding method, if the long-term prediction is selected in the prediction scheme selecting sub-step.

19. A coding apparatus, comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a selection result output sub-step of outputting a selection code that indicates to select the prediction coding method, if an evaluation value that indicates a deviation of the samples in the frame is smaller than a predetermined fourth threshold.

20. A coding apparatus, comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a selection result output sub-step of outputting a selection code that indicates to select the normalization coding method, if it is determined that the difference between a maximum value and a minimum value of the samples in the frame is 1.

21. A coding apparatus, comprising:

a computer processor configured to:

select a coding method that produces a smaller code amount between a prediction coding method that codes an amplitude of a prediction error resulting from linear prediction of samples in a frame and a normalization coding method that normalizes an amplitude of the samples in the frame and codes the normalized amplitude, and output a selection code that indicates the selection result; and code the samples in the frame according to the selected coding method to produce a compression code, wherein the selection of the coding method comprises:

a prediction error calculating sub-step of calculating a prediction error;

a prediction code amount estimating sub-step of estimating the amount of prediction code produced by the prediction coding method, using the prediction error;

a range calculating sub-step of calculating a range U based on values of all samples in the frame;

an amplitude bit count calculating sub-step of calculating an amplitude bit count V using the range U according to $V=\log_2 U$;

a normalization code amount estimating sub-step of estimating the amount of normalization code produced by the normalization coding method using the amplitude bit count V; and a selection result output sub-step of outputting a selection code that indicates to select the coding method that produces the smaller code amount between the prediction coding and the normalization coding based on the estimated amount of prediction code and the estimated amount of normalization code.

22. A non-transitory computer-readable recording medium in which a program that makes a computer function as each part of a coding apparatus according to any one of claims 12, 13, 16, 17, 18, 19, 20, and 21 is recorded.

* * * * *